US011407138B2

(12) United States Patent
Masatoshi et al.

(10) Patent No.: US 11,407,138 B2
(45) Date of Patent: Aug. 9, 2022

(54) ELECTRIC TOOL

(71) Applicant: Nanjing Chervon Industry Co., Ltd., Nanjing (CN)

(72) Inventors: Fukinuki Masatoshi, Nanjing (CN); Xin Yang, Nanjing (CN); Bing Lu, Nanjing (CN); Songsong Lu, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 139 days.

(21) Appl. No.: 16/904,012

(22) Filed: Jun. 17, 2020

(65) Prior Publication Data

US 2020/0316809 A1 Oct. 8, 2020

Related U.S. Application Data

(63) Continuation of application No. 15/863,246, filed on Jan. 5, 2018, now Pat. No. 10,759,080.

(30) Foreign Application Priority Data

Jan. 22, 2017 (CN) ..... 201720083938.3
Jan. 22, 2017 (CN) ..... 201720083939.8

(51) Int. Cl.

| | |
|---|---|
| ***B25F 5/00*** | (2006.01) |
| ***B27B 9/02*** | (2006.01) |
| ***B27B 9/00*** | (2006.01) |
| ***B25F 5/02*** | (2006.01) |

(52) U.S. Cl.

CPC ..... *B27B 9/02* (2013.01); *B25F 5/008* (2013.01); *B25F 5/02* (2013.01); *B27B 9/00* (2013.01)

(58) Field of Classification Search

CPC .... B25F 5/008; B25F 5/02; B25F 9/00; B25F 9/02

See application file for complete search history.

(56) References Cited

U.S. PATENT DOCUMENTS 4,353,165 A * 10/1982 Albery ..... B23D 59/002 30/376
4,856,394 A * 8/1989 Clowers ..... B23D 59/006 83/56
8,286,358 B2 * 10/2012 Kuragano ..... B27B 9/02 30/377
8,479,840 B2 7/2013 Hartmann
9,399,275 B2 7/2016 Esenwein et al.

(Continued)

FOREIGN PATENT DOCUMENTS

CN 106235908 A 12/2016
DE 102015101907 A1 * 8/2016 ..... B27B 9/02

(Continued)

*Primary Examiner* — Stephen Choi
(74) *Attorney, Agent, or Firm* — Greenberg Traurig, LLP

(57) ABSTRACT

An electric tool includes a functional piece, a motor, a case and a fan. The case includes a motor case portion. An airflow inlet and an airflow outlet are formed in the case. When the fan operates, an airflow at the airflow inlet is taken out and is directed to the airflow outlet after the airflow flows through the motor. The motor case portion includes an encircling portion which encircles the motor and an end portion arranged on one end of the encircling portion. A stopping piece stops the airflow from flowing back from one side of the motor to the other side.

19 Claims, 23 Drawing Sheets

(56) References Cited

U.S. PATENT DOCUMENTS

| | | | |
|---|---|---|---|
| 9,718,180 | B2 | 8/2017 | Hester et al. |
| 2011/0036610 | A1 | 2/2011 | Vollmer et al. |
| 2016/0248295 | A1 | 8/2016 | Nakashima |
| 2017/0071134 | A1 | 3/2017 | Li et al. |

FOREIGN PATENT DOCUMENTS

| | | | |
|---|---|---|---|
| EP | 2647472 | A1 | 10/2013 |
| EP | 2682214 | A1 | 1/2014 |

* cited by examiner

ELECTRIC TOOL

CROSS REFERENCE TO RELATED APPLICATION

This application is a continuation of U.S. patent application Ser. No. 15/863,246 filed Jan. 5, 2018, now U.S. Pat. No. 10,759,080, which claims the benefit of CN 201720083939.8, filed on Jan. 22, 2017, and CN 201720083938.3, filed on Jan. 22, 2107, the disclosures of which are each incorporated herein by reference in their entirety.

FIELD OF THE DISCLOSURE

The present disclosure relates to an electric tool, and particularly relates to an electric saw.

BACKGROUND OF RELATED ART

An electric circular saw is a tool which performs sawing operation by driving a saw blade, and has characteristics of safety and reliability, reasonable structure, high working efficiency and the like. The electric circular saw generally includes a case, a motor, a bottom plate, an angle regulating mechanism, a depth regulating structure and a guide apparatus.

When the electric circular saw is used, a user often needs to operate the saw at an elevated location in which case the electric circular saw needs to be suspended. In view of this, the electric circular saw may further include a hook for suspension. However, a position and a structure of an existing hook are set unreasonably, which generally interferes with the hands of the user operating the electric circular saw, thereby affecting use of the saw by the user.

The motor is arranged in the case, and a phenomenon that a heat radiating airflow flows back may appear at the motor, thereby causing a poor temperature rise effect of the motor.

The angle regulating mechanism is arranged on the bottom plate and is used by the user to regulate an inclination angle of the saw blade for cutting. But when the user regulates the inclination angle, it is often difficult to implement setting of the inclination angle quickly and accurately.

The depth regulating mechanism is used by the user to regulate a cutting depth of the saw blade. However, an existing depth regulating mechanism often swings, thereby causing a scale indication error.

The guide apparatus is configured to guide the saw blade to implement straight-line cutting. An existing guide apparatus generally can only implement short-distance straight-line cutting.

In addition, an existing electric circular saw generally secures the saw blade to a main body through a screw. In this way, when the saw blade needs to be disassembled and assembled, auxiliary apparatuses such as a screwdriver and the like need to be used, which is disadvantageous to operation by the user.

SUMMARY

To solve defects of an existing art, one purpose of the present disclosure is to provide an electric tool with good heat radiating effect.

To realize the above purpose, the present disclosure adopts the following technical solution.

An electric tool includes a functional piece, a motor, a case and a fan. The functional piece is configured to implement a tool function. The motor is configured to drive the functional piece. The case includes a motor case portion for accommodating the motor. The fan is arranged on one side of the motor away from the functional piece. An airflow inlet and an airflow outlet are formed in the case. When the fan operates, an airflow at the airflow inlet is taken out, and is directed to the airflow outlet after the airflow interacts with the motor. The motor case portion includes an encircling portion which encircles the motor and an end portion arranged on one end of the encircling portion. The motor includes a stator, a motor shaft and a rotor. The stator is fixed relative to the case. The motor shaft is rotatably arranged in the case. The rotor surrounds the stator and rotates synchronously with the motor shaft, wherein the electric tool further includes a stopping piece. The stopping piece includes a stopping portion arranged at a first clearance between the rotor and the encircling portion. A projection of the stopping piece in a plane perpendicular to a rotating axis of the rotor is at least partially located outside a projection of the rotor in the plane.

Further, the stopping piece may form a fixed connection with the stator.

Further, the stopping portion may encircle the rotor and the stopping piece may include a first extending portion extending along a radial direction from the stopping portion to a direction away from the motor and extending to an outer side of the first clearance between the rotor and the encircling portion in the radial direction.

Further, the stopping piece may include a second extending portion extending along the radial direction from the stopping portion to a direction close to the motor and extending to an outer side of the first clearance between the rotor and the encircling portion in the radial direction.

Further, the stopping portion may extend along a direction parallel to the rotating axis of the rotor, and a length of the stopping portion in the direction parallel to the rotating axis of the rotor is greater than a length of the first extending portion in the radial direction.

Further, a second clearance may be formed between the stopping portion and the encircling portion, and a maximum size of the second clearance between the stopping portion and the encircling portion in the radial direction is less than a minimum size of the first clearance between the rotor and the encircling portion in the radial direction.

Further, the maximum size of the second clearance between the stopping portion and the encircling portion in the radial direction may be greater than 0 mm and less than or equal to 2 mm.

Further, the fan is preferably a centrifugal fan.

Further, the rotor may be formed with a vent hole located at one side of the stator close to the fan.

An electric saw includes a cutting piece, a motor, a case and a fan. The cutting piece is configured to cut a workpiece. The motor is configured to drive the cutting piece. The case includes a motor case portion for accommodating the motor. The fan is arranged on one side of the motor away from the cutting piece. An airflow inlet and an airflow outlet are formed in the case. When the fan operates, an airflow at the airflow inlet is taken out, and is directed to the airflow outlet after the airflow interacts with the motor. The motor case portion includes an encircling portion which encircles the motor and an end portion arranged on one end of the encircling portion. The motor includes a stator, a motor shaft and a rotor. The stator is fixed relative to the case. The motor shaft is rotatably arranged in the case. The rotor surrounds the stator and forms synchronous rotation with the motor shaft, wherein the electric saw further includes a stopping piece at least partially arranged at a first clearance between the rotor and the encircling portion for stopping the airflow from flowing back from one side of the motor close to the fan to the other side.

The present disclosure has a beneficial effect that the stopping piece for stopping the airflow from flowing back is arranged between the case and the motor, thereby improving a temperature rise effect of the motor.

DETAILED DESCRIPTION

Figure 1:
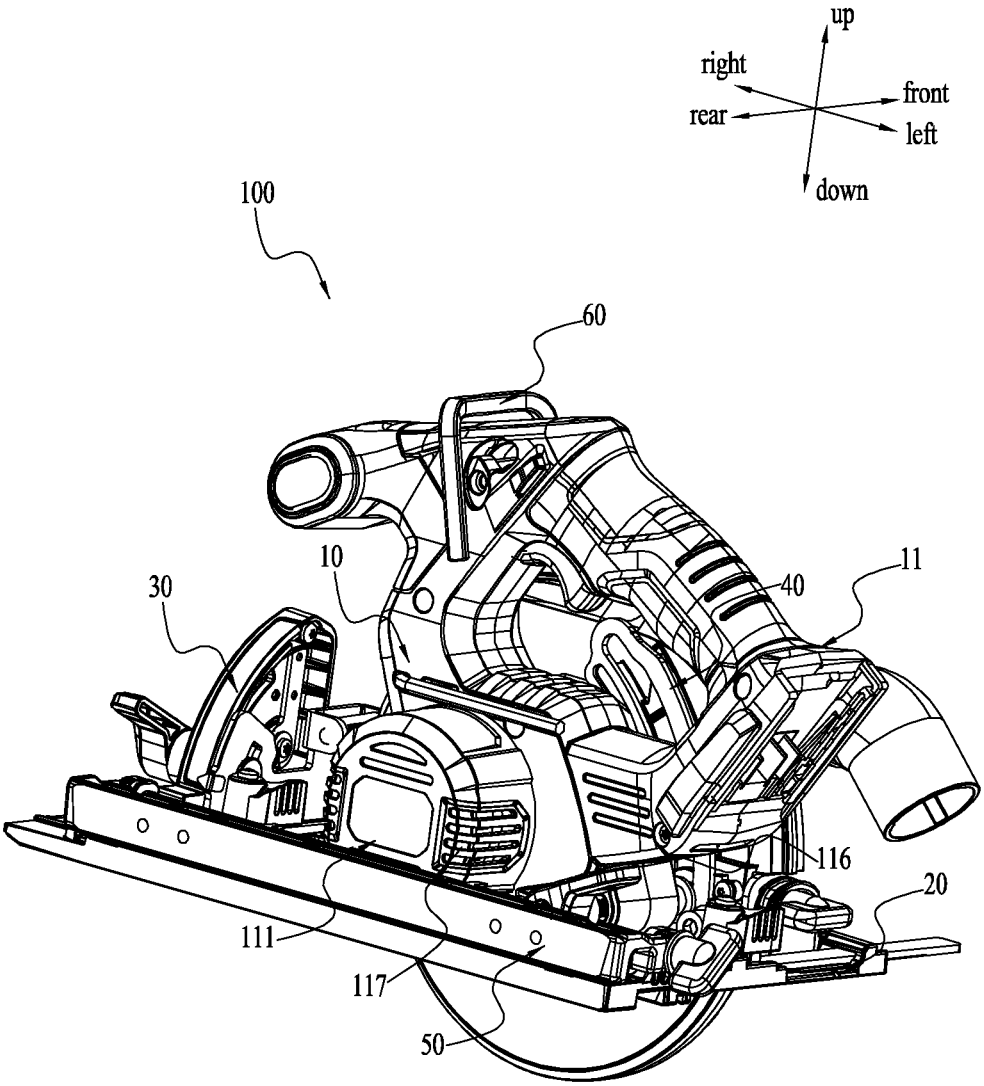
FIG. 1 is a three-dimensional diagram illustrating an electric circular saw as an example.
Figure 2:
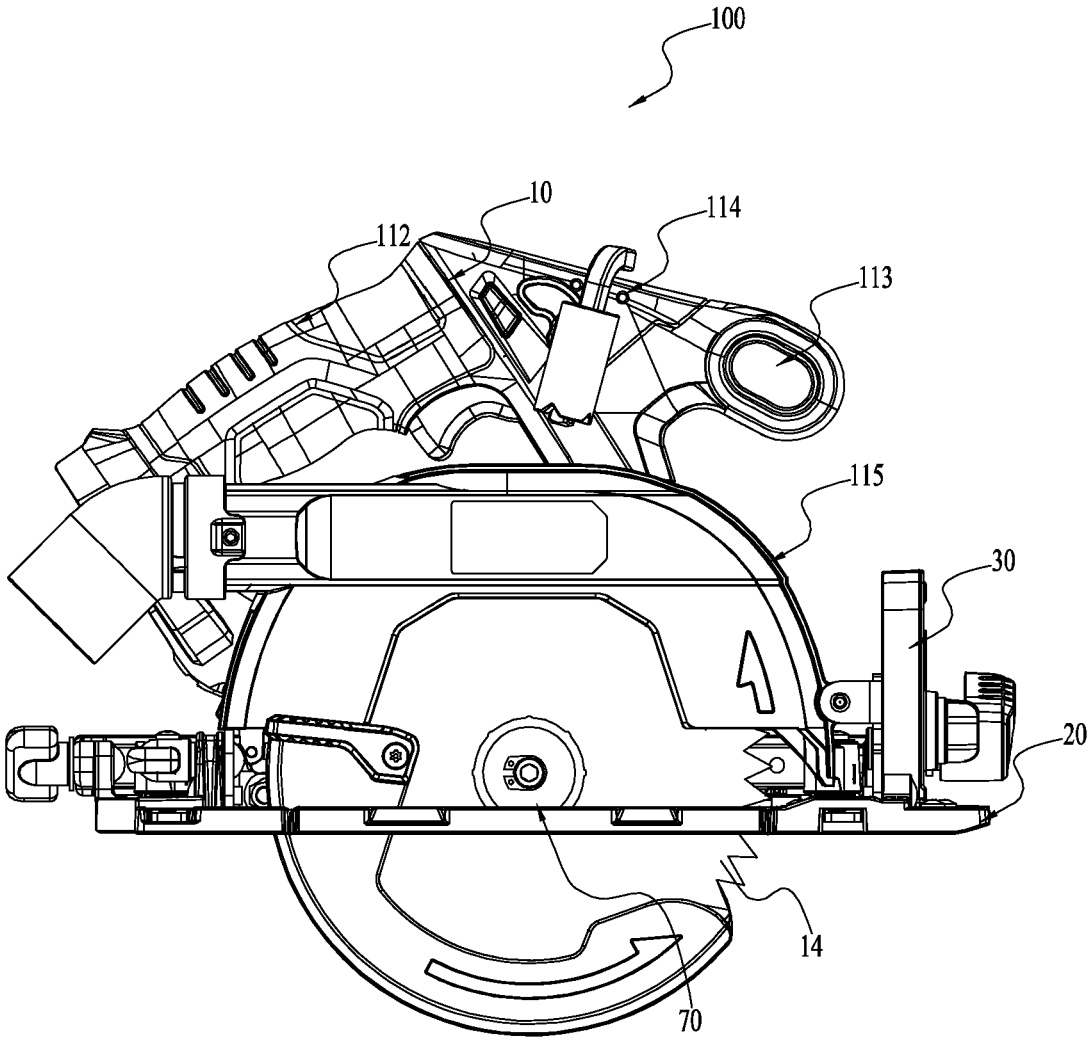
FIG. 2 is a planar diagram illustrating the electric circular saw in FIG. 1.
Figure 3:
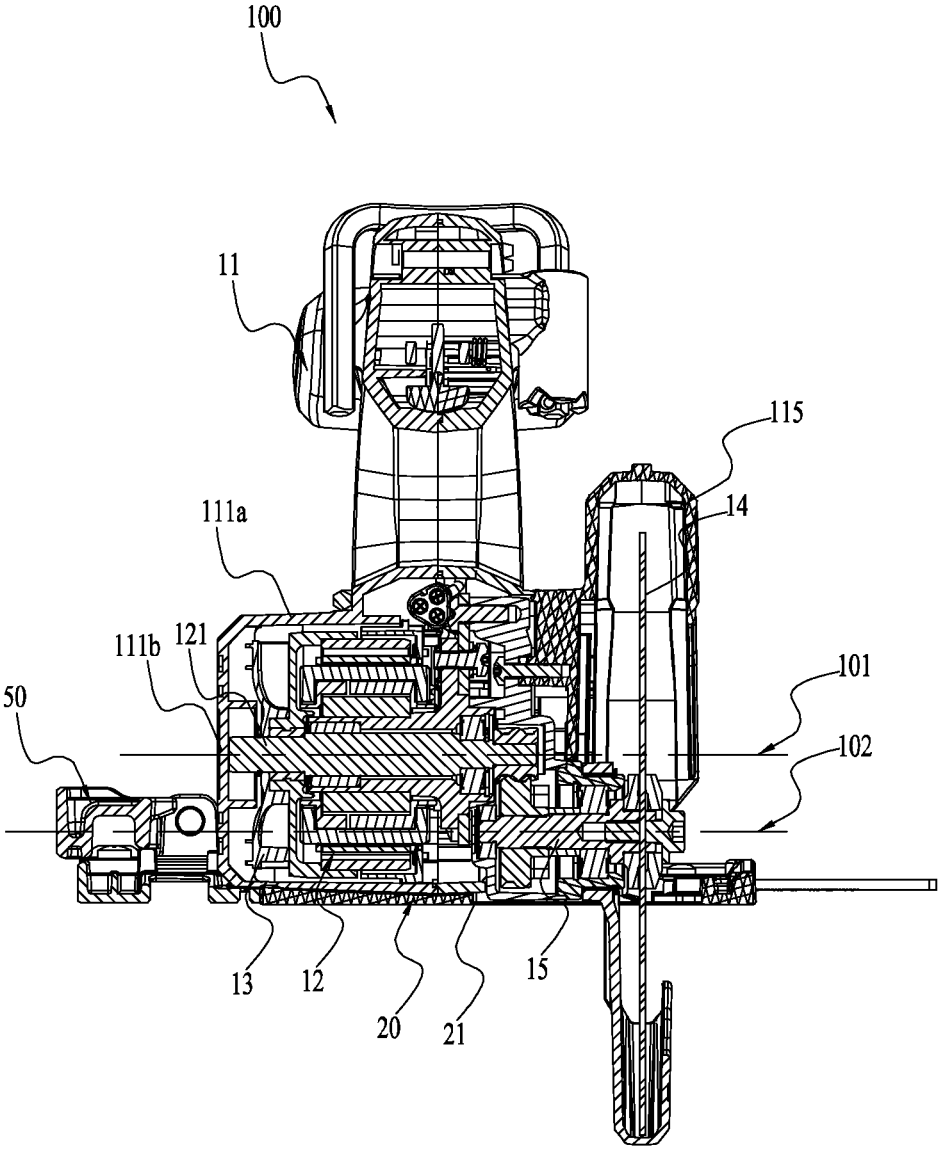
FIG. 3 is a sectional view illustrating the electric circular saw in FIG. 1.

A power tool shown in FIG. 1 to FIG. 3 is a handheld power tool, and specifically is an electric cutting tool. The cutting tool is further an electric saw. More specifically, the electric saw may be an electric circular saw 100.

As shown in FIG. 1 and FIG. 2, the electric circular saw 100 includes a tool main engine 10, a bottom plate 20, an angle regulating mechanism 30, a depth regulating mechanism 40, a guide apparatus 50 and a hook assembly 60.

For the convenience of describing technical solutions of the present disclosure, an upper side, a lower side, a front side, a rear side, a left side and a right side shown in FIG. 1 are further defined.

As shown in FIG. 1 to FIG. 3, the tool main engine 10 includes a case 11, a motor 12, a fan 13, a working accessory 14 and a driving shaft 15.

The case 11 is configured to accommodate structures such as the motor 12, the fan 13, the driving shaft 15 and the like. The motor 12 serves as a prime mover of the electric circular saw 100 and is configured to output power and drive the working accessory 14. The motor 12 includes a motor shaft 121 capable of rotating by using a motor axis 101 as an axis. The fan 13 can perform synchronous rotation with the motor shaft 121, thereby radiating heat of structures such as the motor 12 and the like. The working accessory 14 serves as a functional piece of the electric circular saw 100 and is configured to implement a tool function. The working accessory 14 may be a cutting piece used for implementing a cutting function. For the electric circular saw 100, the working accessory 14 specifically may be a circular saw blade. The driving shaft 15 serves as an output piece of the electric circular saw 100 and is configured to output power. The driving shaft 15 is arranged between the motor 12 and the working accessory 14 to drive the working accessory 14. Specifically, the driving shaft 15 is configured to drive the saw blade to rotate around a rotating axis 102 which penetrates through the saw blade. It can be understood for those skilled in the art that for the electric circular saw 100, the driving shaft 15 may be an independent shaft which can be driven by the motor 12 and can also be directly formed by the motor shaft 121 of the motor 12.

Specifically, the case 11 may include a motor case portion 111, a main handle portion 112, an auxiliary handle portion 113, a connecting portion 114 and a protective cover 115. The motor case portion 111 is used for accommodating the motor 12. The motor case portion 111 further includes an encircling portion **111*a* which encircles the motor 12 along a circumferential direction surrounding the motor axis 101, and an end portion 111***b* arranged on one end of the encircling portion 111*a* away from the working accessory 14. The main handle portion 112 and the auxiliary handle portion 113 are respectively used for both hands of the user to hold, thereby achieving a purpose of holding the electric circular saw 100 with both hands, so that the user can operate the electric circular saw 100 more stably. The connecting portion 114 is arranged between the main handle portion 112 and the auxiliary handle portion 113, and is configured to connect the main handle portion 112 and the auxiliary handle portion 113. The protective cover 115 is configured to partially surround the saw blade, thereby preventing the saw blade from throwing debris during work.

As shown in FIG. 1 to FIG. 4, the fan 13 is located in the motor case portion 111, the fan 13 is also arranged on one side of the motor 12 away from the working accessory 14, and the fan 13 is specifically a centrifugal fan. An airflow inlet 116 and an airflow outlet 117 are further formed in the case 11. The airflow inlet 116 is communicated with an inner portion and an outer portion of the case 11, and the airflow outlet 117 is communicated with an inner portion and an outer portion of the case 11, wherein a position of the airflow inlet 116 in the case 11 can correspond to electronic elements such as a circuit board and the like in the case 11. The airflow outlet 117 is arranged at one side of the motor 12 away from the working accessory 14, and the airflow outlet 117 is also arranged at one end of the encircling portion 111*a* close to the end portion. In this way, when the motor 12 drives the fan 13 to rotate, the fan 13 can take out an airflow at the airflow inlet 116 and the airflow is directed to the airflow outlet 117 after the airflow interacts with the circuit board and the motor 12, thereby achieving an effect of radiating heat for the motor 12 and the circuit board.

As shown in FIG. 1 to FIG. 6, specifically, the motor 12 is an outer rotor motor and includes a stator 122, a rotor 123 and the above mentioned motor shaft 121. The stator 122 is fixedly arranged in the case 11. The motor shaft 121 is rotatably arranged in the case 11. The rotor 123 surrounds the stator 122 and forms synchronous rotation with the motor shaft 121. One side of the rotor 123 close to the fan 13 is further provided with a vent hole 123*a* for an airflow to pass through. In this way, after the motor 12 is started, an airflow enters from a front side of the motor 12 and flows through the stator 122, and then flows out through the vent hole 123*a* at the rear side of the motor 12, and finally flows to the airflow outlet 117. However, since the rotor 123 is rotatably arranged in the case 11, a certain clearance exists between inner walls of the case 11 and the rotor 123. Further, the clearance refers to a first clearance 124 between inner walls of the encircling portion 111*a* and the rotor 123. In this way, the airflow flowing out of the rear side of the motor 12 may flow back from rear to front through the first clearance 124 between the inner walls of the encircling portion 111*a* and the rotor 123, causing temperature rise of the motor 12 and being disadvantageous to heat radiation of the motor 12. In view of this, the electric circular saw 100 further includes a stopping piece 125 for stopping the airflow from flowing back from one side of the motor 12 close to the fan 13 to the other side, i.e., the stopping piece 125 is configured to stop the airflow flowing out of the rear side of the motor 12 from flowing back from the rear side of the motor 12 to the front side of the motor 12 through the first clearance 124 between the rotor 123 and the encircling portion 111*a*, thereby improving a heat radiating effect of the motor 12.

Figure 4:
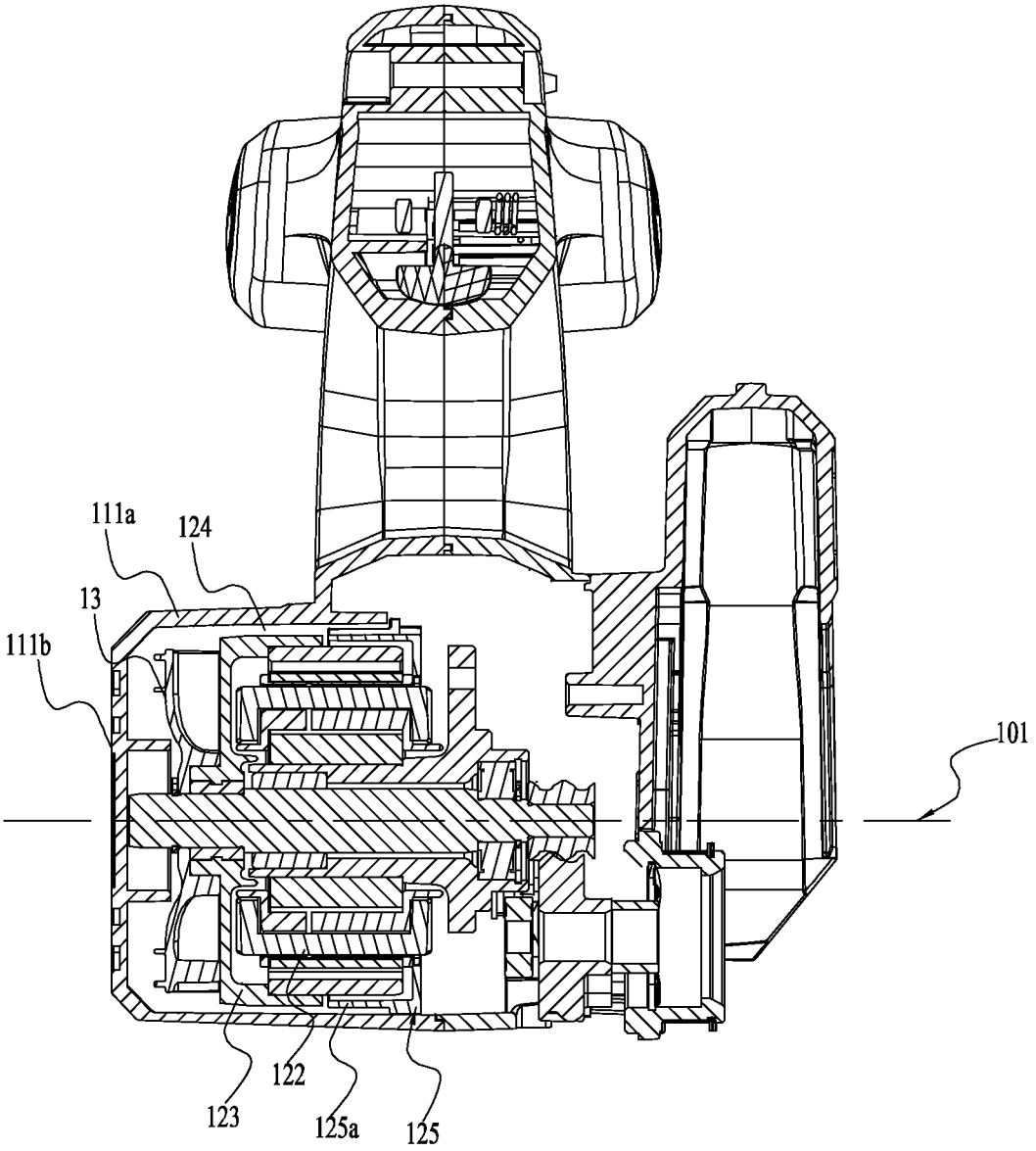
FIG. 4 is a sectional view illustrating part of a case, a motor and a fan in FIG. 1.
Figure 5:
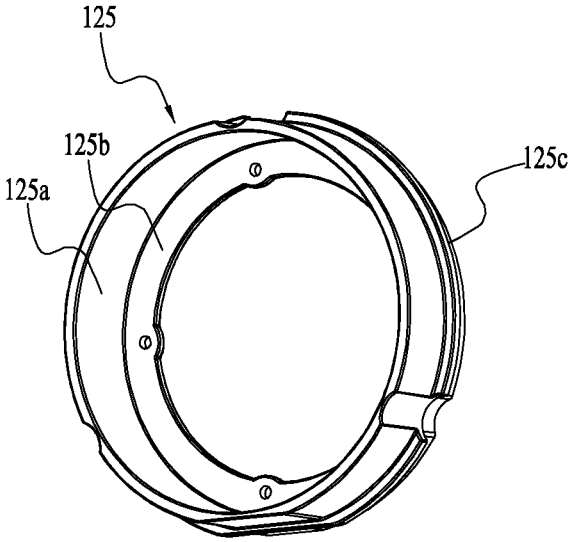
FIG. 5 is a three-dimensional diagram illustrating a stopping piece in FIG. 4.
Figure 6:
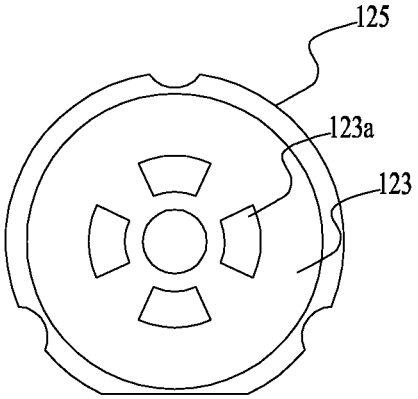
FIG. 6 is a schematic diagram illustrating projections of an encircling portion and the stopping piece in FIG. 4 in a plane perpendicular to a rotating axis of a rotor.

The stopping piece 125 is fixedly arranged in the case 11. Further, the stopping piece 125 forms fixed connection with the stator 122. As shown in FIG. 3 and FIG. 4, the stopping piece 125 includes a stopping portion 125*a* arranged at the first clearance 124 between the rotor 123 and the encircling portion 111*a*. In addition, as shown in FIG. 3 and FIG. 5, a projection of the stopping piece 125 in a plane perpendicular to a rotating axis of the rotor 123 is at least partially located outside a projection of the rotor 123 in the plane, wherein the rotating axis of the rotor 123 coincides with the motor axis 101 of the motor 12.

Specifically, the stopping piece 125 further includes a first extending portion 125*b* and a second extending portion 125*c*. The first extending portion 125*b* extends along a radial direction from the stopping portion 125*a* to a direction away from the motor 12, and the first extending portion 125*b* extends to an outer side of the first clearance 124 between the rotor 123 and the encircling portion 111*a* in the radial direction. The second extending portion 125*c* extends along the radial direction from the stopping portion 125*a* to a direction close to the motor 12, and the second extending portion 125*c* extends to an outer side of the first clearance 124 between the rotor 123 and the encircling portion 111*a* in the radial direction. Namely, the first extending portion 125*b* extends outwards from an outer wall of the stopping portion 125*a*, and the second extending portion 125*c* extends inwards from an inner wall of the stopping portion 125*a*. In addition, the stopping portion 125*a* extends along a direction parallel to the rotating axis of the rotor 123, and a length of the stopping portion 125*a* in the direction parallel to the rotating axis of the rotor 123 is greater than a length of the first extending portion 125*b* in the radial direction. Further, the length of the stopping portion 125*a* in the direction parallel to the rotating axis of the rotor 123 is greater than 10 mm, so that the length of the stopping portion 125*a* is long enough, thereby achieving a better wind stopping effect. It should be noted that the radial direction herein refers to a radius direction of a circumferential direction by using the rotating axis of the rotor 123 as a center.

Figure 7:
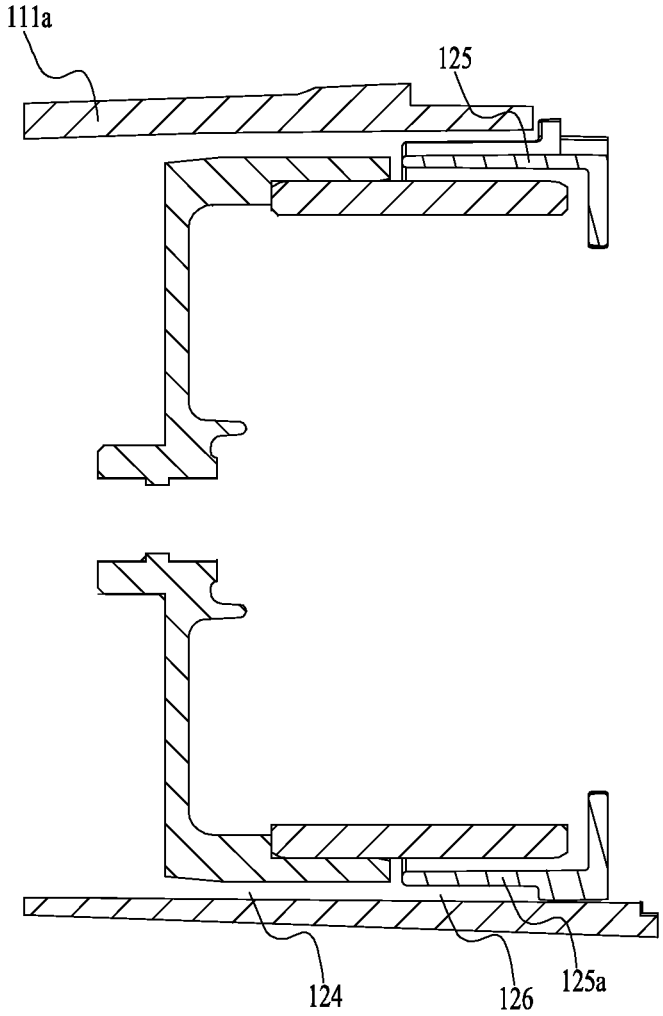
FIG. 7 is a sectional view illustrating the encircling portion, the rotor and the stopping piece in FIG. 4.

As shown in FIG. 7, a second clearance 126 is formed between the stopping portion 125*a* and the encircling portion 111*a*, and a maximum size of the second clearance 126 between the stopping portion 125*a* and the encircling portion 111*a* in the radial direction is less than a minimum size of the first clearance 124 between the rotor 123 and the encircling portion 111*a* in the radial direction. Further, the maximum size of the second clearance 126 between the stopping portion 125*a* and the encircling portion 111*a* in the radial direction is greater than 0 mm and less than or equal to 2 mm. It should be noted that the radial direction herein refers to a radius direction of a circumferential direction by using the rotating axis of the rotor 123 as a center.

Figure 8:
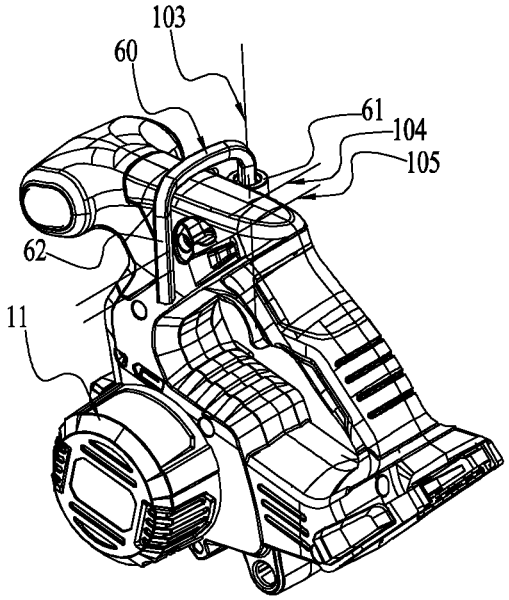
FIG. 8 is a three-dimensional diagram illustrating part of a case and a hook assembly in FIG. 1, wherein a connecting piece is in a first position.

As shown in FIG. 1 and FIG. 8, the electric circular saw 100 is a handheld electric tool. When the user operates the electric circular saw 100, especially when the user performs operation at an elevated location, the electric circular saw 100 often needs to be suspended through the hook assembly 60 for later use after the electric circular saw 100 is used for operation for a period of time. The hook assembly 60 specifically may include a connecting piece 61 and a hook piece 62, wherein the connecting piece 61 is configured to connect the hook assembly 60 to the case 11, and the hook piece 62 is configured to suspend the electric circular saw 100.

Figure 9:
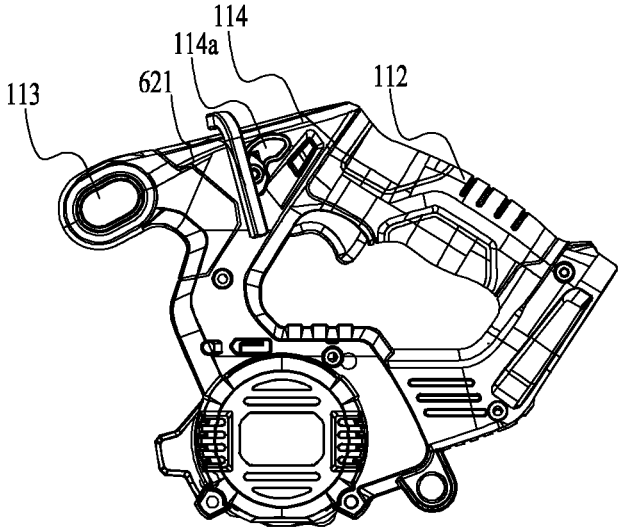
FIG. 9 is a planar diagram illustrating a structure shown in FIG. 8.
Figure 10:
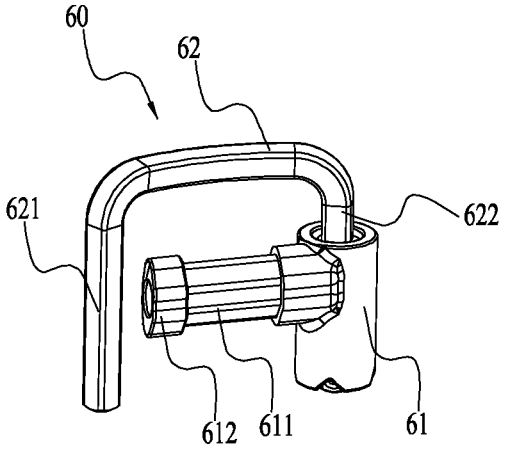
FIG. 10 is a three-dimensional diagram illustrating the hook assembly in FIG. 8.

Specifically, as shown in FIG. 8 to FIG. 10, the hook assembly 60 is arranged on the connecting portion 114 of the case 11 and is located between the main handle portion 112 and the auxiliary handle portion 113. Specifically, the hook piece 62 includes a hook portion 621 and a handle portion 622, wherein the handle portion 622 and the connecting piece 61 form a rotatable connection by using a first axis 103 as an axis, and the first axis 103 is further perpendicular to the rotating axis 102 of the saw blade.

Figure 11:
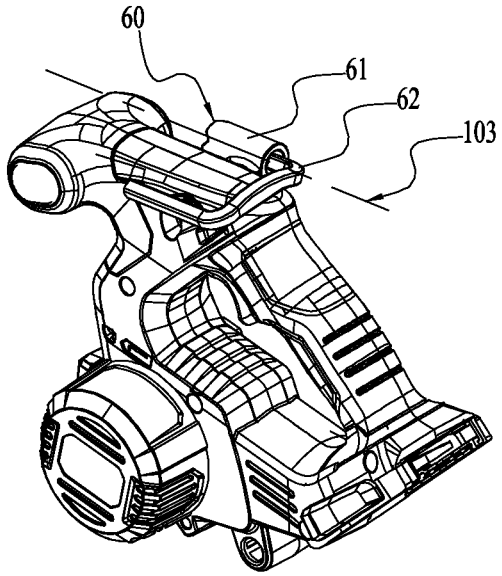
FIG. 11 is a three-dimensional diagram illustrating part of the case and the hook assembly in FIG. 1, wherein a connecting piece is in a second position.

As shown in FIG. 8 and FIG. 11, the connecting piece 61 can move relative to the case 11 between the first position and the second position; after the connecting piece 61 moves from the first position to the second position, the connecting piece 61 generates autorotation relative to the connecting piece 61 and an autorotation axis 104, surrounding which the connecting piece 61 generates autorotation relative to the connecting piece 61, further generates displacement; the autorotation axis 104, surrounding which the connecting piece 61 generates autorotation relative to the connecting piece 61, is perpendicular to the first axis 103; and the autorotation axis 104 of the connecting piece 61 is further parallel to the rotating axis 102 of the saw blade.

Specifically, an arc-shaped groove 114*a* is formed in the case 11, and the arc-shaped groove 114*a* is formed in the connecting portion 114. The arc-shaped groove 114*a* is further a circular-arc-shaped groove. The connecting piece 61 further includes a movable portion 611. The movable portion 611 can move in the arc-shaped groove 114*a* along an extension direction of the arc-shaped groove 114*a*. The connecting piece 61 is respectively in the first position and the second position when the movable portion 611 moves to both ends of the arc-shaped groove 114*a* in the arc-shaped groove 114*a*.

As shown in FIG. 8 and FIG. 9, when the connecting piece 61 is in the first position, the hook portion 621 of the hook piece 62 basically extends downwards, so that the hook portion 621 will not interfere with the hands of the user when both hands of the user respectively hold the main handle portion 112 and the auxiliary handle portion 113, thereby facilitating operation of the user. In fact, the case 11 may further form a groove having other shapes for the movable portion 611 to move. For example, the groove can enable the movable portion 611 to generate autorotation first and then generate movement along a linear direction. In this way, after the connecting piece 61 moves from the first position to the second position, the connecting piece 61 still can generate autorotation relative to the connecting piece 61 and the autorotation axis 104, surrounding which the connecting piece 61 generates autorotation relative to the connecting piece 61, further generates displacement. Therefore, such an embodiment actually belongs to a protecting scope of the present disclosure.

As mentioned above, the arc-shaped groove 114*a* is a circular-arc-shaped groove. A center line corresponding to a circular-arc-shaped groove wall of the arc-shaped groove 114*a* is perpendicular to the first axis 103. Thus, it can be understood that a process that the connecting piece 61 moves along the extension direction of the arc-shaped groove 114*a* from the first position to the second position may further be regarded as a process that the connecting piece 61 revolves relative to the case 11 by using the second axis 105, which does not coincide with the autorotation axis 104 of the connecting piece 61, as an axis; the second axis 105 is not in the same plane with the first axis 103; and the second axis 105 is further perpendicular to the first axis 103. It should be noted that in the present embodiment, the second axis 105 is the center line corresponding to the circular-arc-shaped groove wall of the arc-shaped groove 114*a* when the connecting piece 61 rotates. In fact, a solution that the connecting piece 61 and the case 11 form rotatable connection by using the second axis 105, which does not coincide with the autorotation axis 104 of the connecting piece 61, as an axis also belongs to the protecting scope of the present disclosure.

Figure 14:
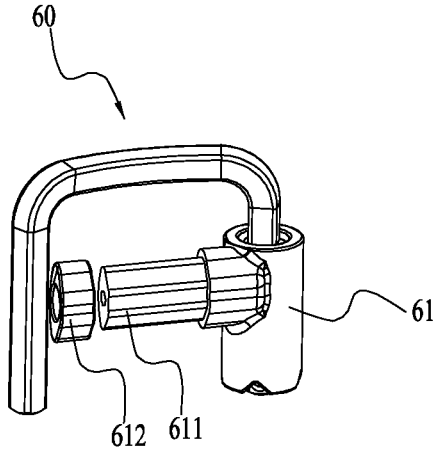
FIG. 14 is a partial explosive view illustrating the hook assembly in FIG. 8.

As shown in FIG. 10 and FIG. 14, the arc-shaped groove 114*a* penetrates through the connecting portion 114 along the direction parallel to the autorotation axis 104 of the connecting piece 61, and the connecting piece 61 further includes a preventing portion 612 forming detachable connection with the movable portion 611. The preventing portion 612 is configured to prevent the movable portion 611 from separating from the arc-shaped groove 114*a*. In this way, when the user installs the hook assembly 60, the preventing portion 612 can be disassembled from the movable portion 611 first; then the movable portion 611 penetrates through the arc-shaped groove 114*a*; and the preventing portion 612 is installed on the movable portion 611, thereby installing the hook assembly 60 on the case 11.

Figure 12:
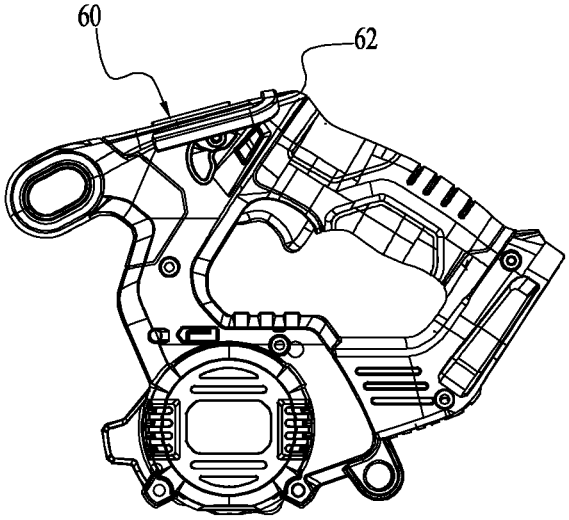
FIG. 12 is a planar diagram illustrating a structure shown in FIG. 11.
Figure 13:
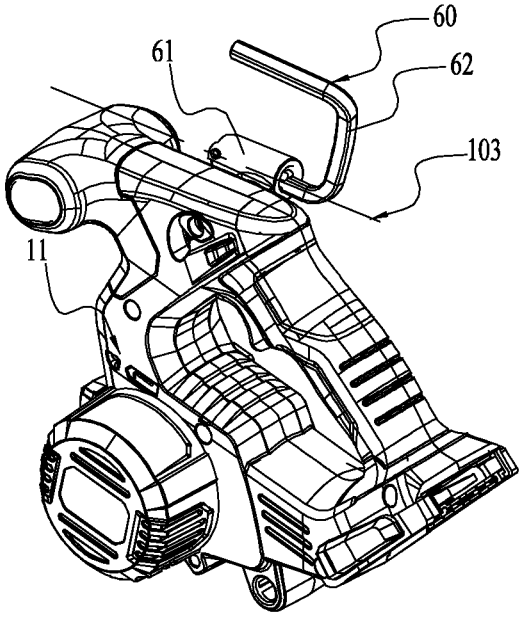
FIG. 13 is a three-dimensional diagram illustrating part of the case and the hook assembly in FIG. 1, wherein the hook assembly rotates by 90 degrees relative to the connecting piece.

A use process of the hook assembly 60 is specifically introduced below. As shown in FIG. 8 and FIG. 9, the connecting piece 61 at this moment is in the first position in the arc-shaped groove 114*a*. Then, the user can use the electric circular saw 100 to perform sawing operation, and the hook piece 62 at this moment does not interfere with both hands of the user holding the main handle portion 112 and the auxiliary handle portion 113, thereby facilitating operation by the user. However, when the user stops using the electric circular saw 100 and needs to suspend the electric circular saw 100, the user can operate the hook assembly 60 so that the connecting piece 61 moves from the first position to the second position along the extension direction of the arc-shaped groove 114*a*. Specifically, as shown in FIG. 11 and FIG. 12, the connecting piece 61 at this moment already moves to the second position. At this moment, the hook piece 62 approximately rotates by 90 degrees relative to the case 11. As shown in FIG. 11 and FIG. 13, then the user can continue to operate the hook assembly 60 so that the hook piece 62 rotates relative to the connecting piece 61 by using the first axis 103 as an axis and approximately rotates by 90 degrees. As shown in FIG. 13, the position of the hook piece 62 relative to the case 11 at this moment can ensure that the hook piece 62 is matched with structures such as cross beams and the like in a working environment to suspend the electric circular saw 100.

Figure 15:
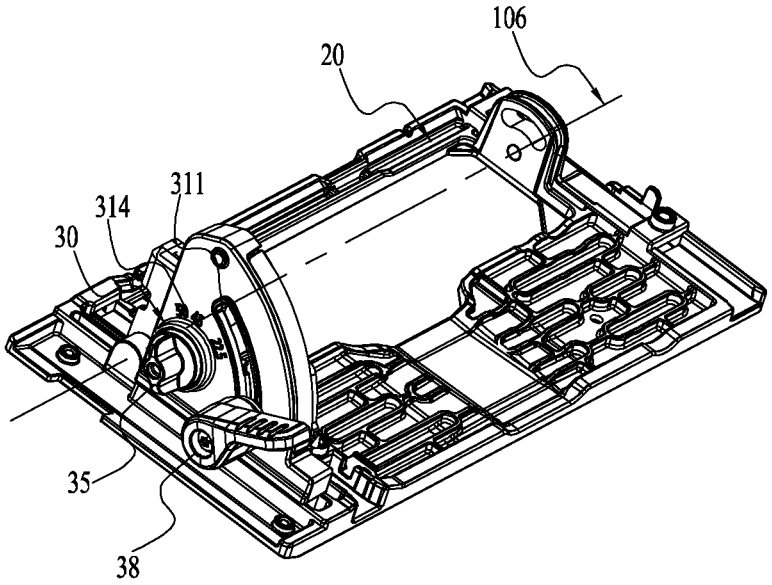
FIG. 15 is a three-dimensional diagram illustrating a bottom plate and an angle regulating mechanism in FIG. 1.
Figure 16:
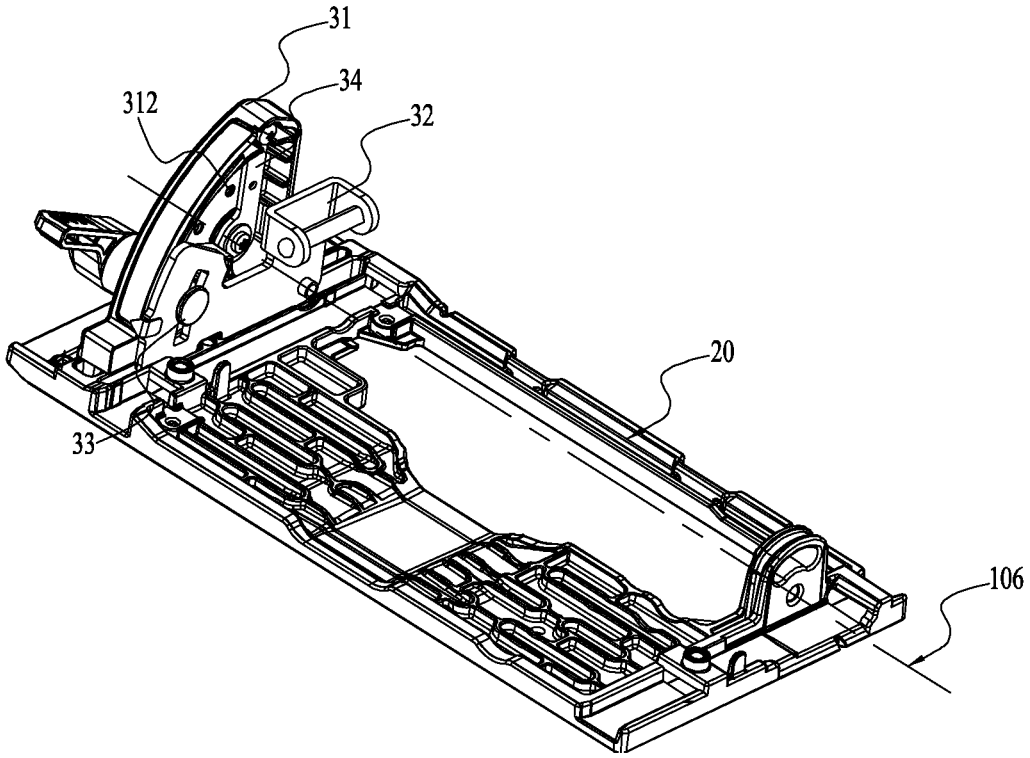
FIG. 16 is a three-dimensional diagram illustrating another angle of the bottom plate and the angle regulating mechanism in FIG. 1.
Figure 17:
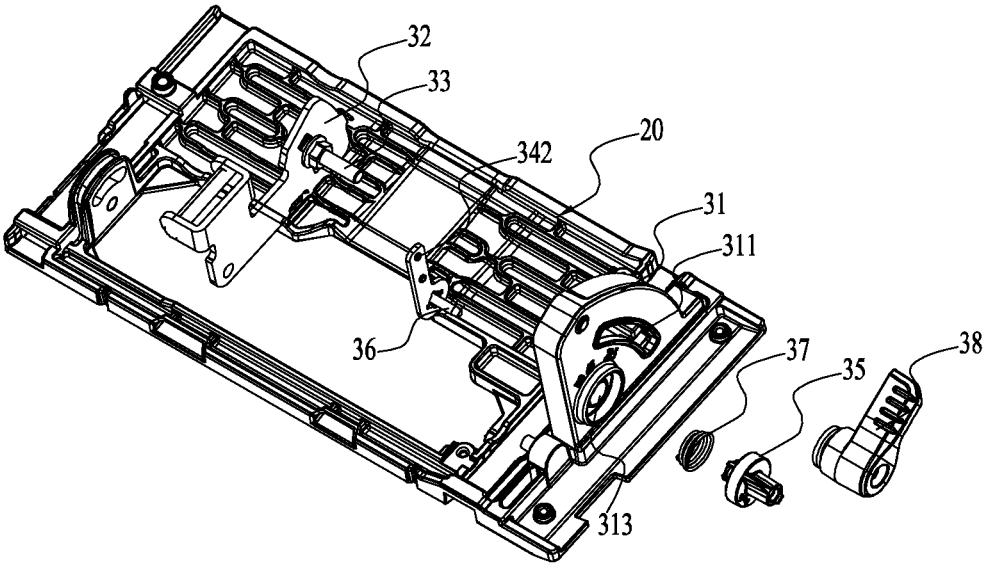
FIG. 17 is an exploded view illustrating a structure shown in FIG. 15.

As shown in FIG. 1, FIG. 15 and FIG. 16, the bottom plate 20 and the case 11 form a rotatable connection using a pivoting axis 106 as an axis. The pivoting axis 106 is perpendicular to the rotating axis 102 of the saw blade. In this way, when the case 11 rotates relative to the bottom plate 20 by using the pivoting axis 106 as an axis, the saw blade of the electric circular saw 100 is inclined, so that the electric circular saw 100 can implement inclined cutting.

Figure 18:
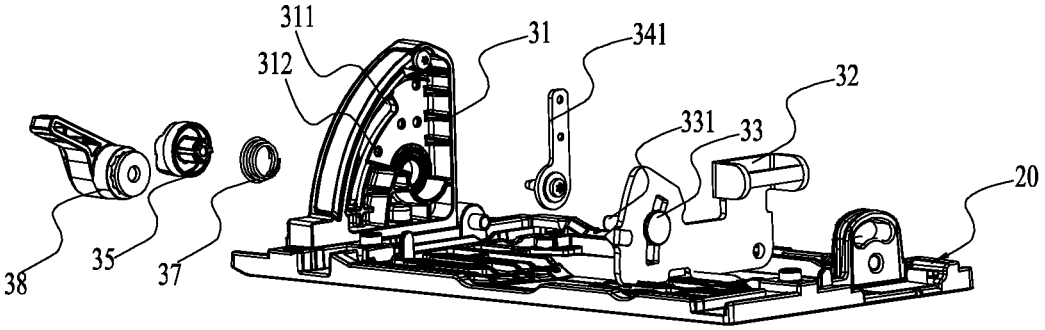
FIG. 18 is an exploded view illustrating another angle of the structure shown in FIG. 15.

As shown in FIG. 1, FIG. 15 and FIG. 18, the angle regulating mechanism 30 is configured to guide the case 11 to rotate relative to the bottom plate 20 by using the pivoting axis 106 as an axis and regulate a rotating angle of the case 11. The angle regulating mechanism 30 includes an angle scale 31, an adapting piece 32, a sliding piece 33, a limiting piece 34 and an operation element 35.

The angle scale 31 is fixedly installed on the bottom plate 20. Further, the angle scale 31 can be integrally formed with the bottom plate 20, and a circular arc groove 311 is formed in the angle scale 31. One end of the adapting piece 32 is connected with the case 11, and the other end of the adapting piece 32 is connected with the sliding piece 33. The sliding piece 33 includes a sliding portion 331 slidably arranged in the circular arc groove 311. One end of the adapting piece 32 connected with the case 11 further forms rotatable connection with the angle scale 31 using the pivoting axis 106 as an axis, so that the sliding piece 33 and the case 11 form connection in a manner of rotating with the case 11 together by using the pivoting axis 106 as an axis. In this way, when the case 11 drives the sliding piece 33 to rotate together by using the pivoting axis 106 as an axis, the sliding portion 331 can slide in the circular arc groove 311, and a sliding distance of the sliding portion 331 in the circular arc groove 311 reflects a rotating angle of the case 11, i.e., reflects an inclined cutting angle of the electric circular saw 100. The limiting piece 34 is configured to limit the sliding portion 331 to slide in the circular arc groove 311 to a preset position towards a direction away from the bottom plate 20. For example, when the sliding portion 331 slides from one end of the circular arc groove 311 close to the bottom plate 20 to a position that makes the inclined cutting angle of the electric circular saw 100 as 45 degrees, the limiting piece 34 at this moment can limit the sliding portion 331 in the position so that the sliding portion 331 cannot continue to slide towards the direction away from the bottom plate 20. The electric circular saw 100 further includes a positioning structure 312 matched with the limiting piece 34 for positioning the limiting piece 34. The number of the positioning structure 312 may be more than one. In this way, when the limiting piece 34 is matched with the positioning structures 312 in different positions, the sliding piece 33 can slide to different preset positions and the operation element 35 is used by the user to operate; and when the user operates the operation element 35, the operation element 35 can further drive the limiting piece 34 to separate matching from the positioning structures 312.

Specifically, the limiting piece 34 is arranged on one side of the angle scale 31 close to the case 11. The limiting piece 34 and the angle scale 31 form a rotatable connection using an axis parallel to the pivoting axis 106 as an axis. The limiting piece 34 further includes a limiting portion 341 in positional correspondence to the circular arc groove 311. The sliding piece 33 is limited by the limiting portion 341. The operation element 35 is arranged on the other side of the angle scale 31 away from the limiting piece 34. A through hole 313 is formed in the angle scale 31. The operation element 35 is connected with the limiting piece 34 through a screw 36 penetrating though the through hole 313. The operation element 35 specifically may be a knob forming synchronous rotation with the limiting piece 34. In this way, when the user operates the knob, the limiting piece 34 can rotate with the knob. The positioning structure 312 is a groove formed in the angle scale 31 and sunk towards a direction away from the limiting piece 34. The limiting piece 34 is formed with a bulge 342 into which the groove can be embedded. It should be noted that, those skilled in the art can understand that positions of the groove and the bulge 342 can be exchanged.

The operation element 35 and the angle scale 31 further form sliding connection along an axis direction in which the limiting piece 34 rotates relative to the angle scale 31. The angle regulating mechanism 30 further includes a biasing piece 37 biasedly arranged between the operation element 35 and the angle scale 31. The biasing piece 37 can ensure that the operation element 35 moves towards a direction away from the angle scale 31 so that the bulge 342 on the limiting piece 34 moves in a position matched with the positioning structure 312 when rotating to be aligned with the positioning structure 312. Scale lines 314 surrounding the through hole 313 are further arranged on the angle scale 31. The user can operate the knob to rotate the knob to a preset angle, thereby implementing rapid positioning of the electric circular saw 100 in different cutting angles.

Further, the angle regulating mechanism 30 further includes a locking piece 38 used for locking a position of the sliding piece 33 in the circular arc groove 311.

How to use the electric circular saw 100 to perform inclined cutting is disclosed below. For example, by taking 45° cutting as an example: firstly, the user presses the operation element 35 so that the operation element 35 overcomes bias pressure of the biasing piece 37, so that the limiting piece 34 is separated from matching with the positioning structure 312; at this moment, the operation element 35 is rotated to a 45° position; then, the limiting piece 34 also rotates with the operation element 35 until the bulge 342 is aligned with another positioning structure 312; then the user releases the operation element 35; at this moment, under the effect of the biasing piece 37, the limiting piece 34 moves towards a position that the limiting piece 34 is matched with the positioning structure 312; then the user enables the sliding piece 33 to slide in the circular arc groove 311 to the limiting portion 341; and finally, the user locks the position of the sliding piece 33 in the circular arc groove 311 through the locking piece 38, thereby implementing rapid positioning of the electric circular saw 100 in 45° cutting.

Figure 19:
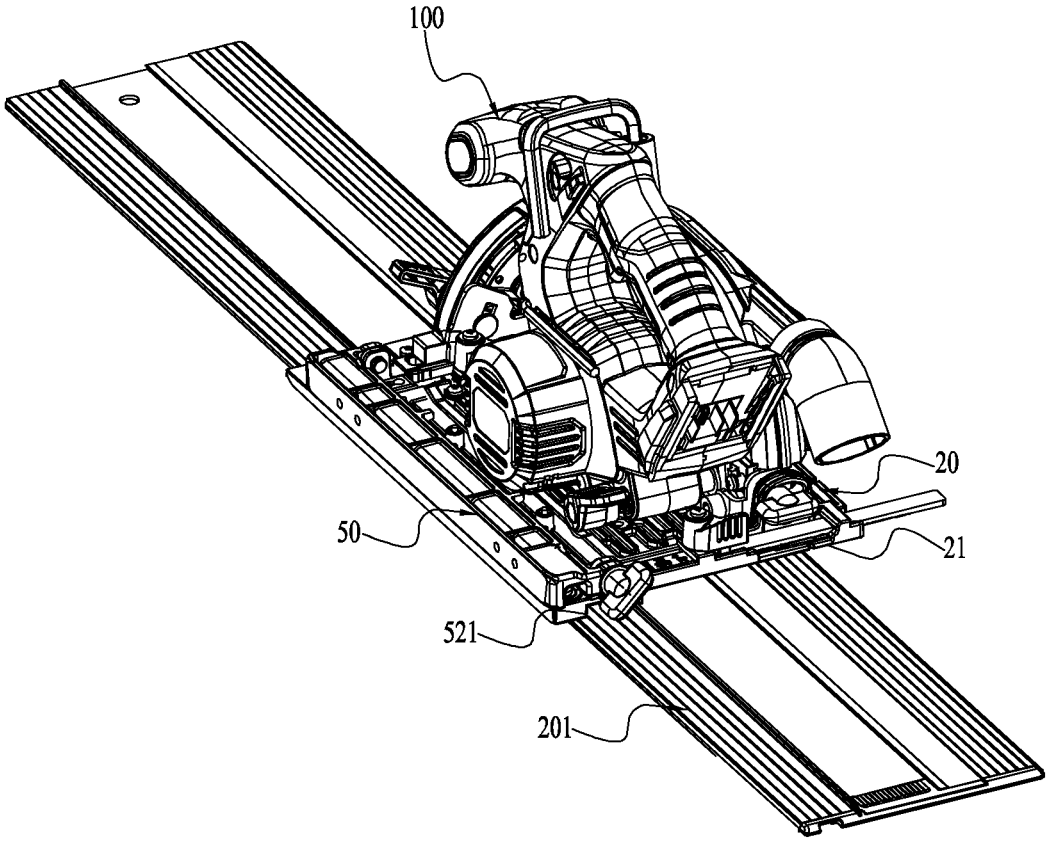
FIG. 19 is a three-dimensional diagram illustrating adapting of the electric circular saw and a guide rail in FIG. 1.
Figure 20:
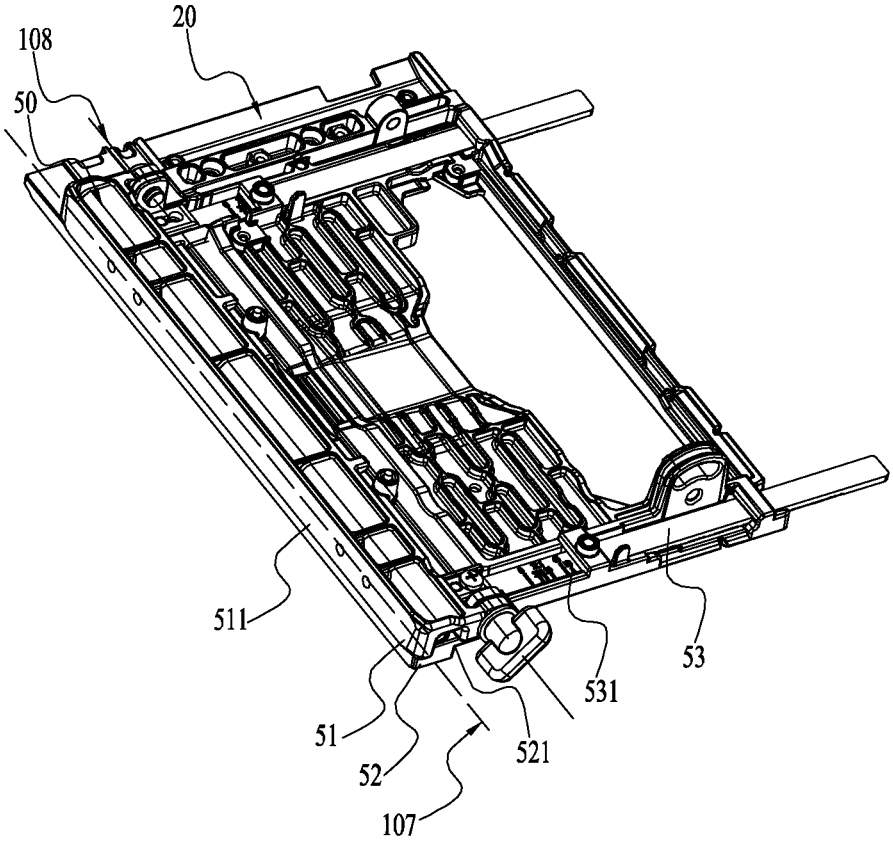
FIG. 20 is a three-dimensional diagram illustrating the bottom plate and a guide apparatus in FIG. 19.
Figure 21:
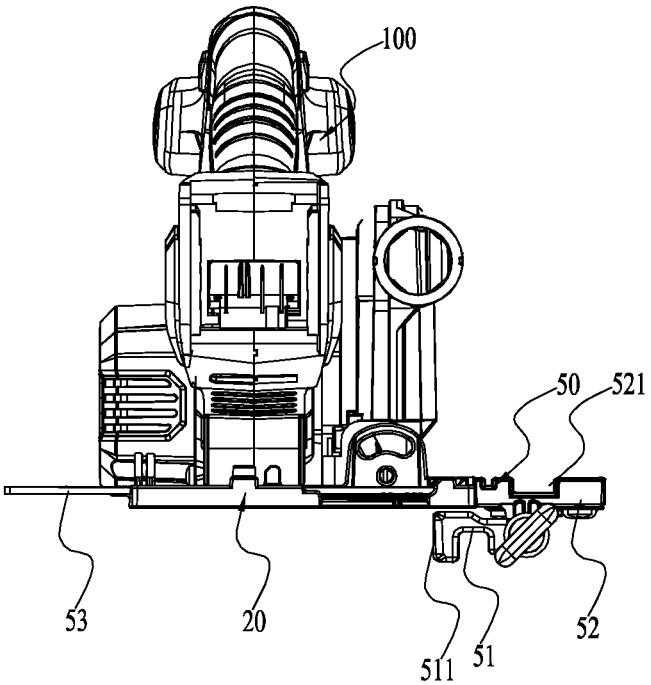
FIG. 21 to FIG. 25 are planar diagrams illustrating the electric circular saw in FIG. 1, and showing a process of movement of the guide apparatus from a second combining position to a first combining position.
Figure 25:
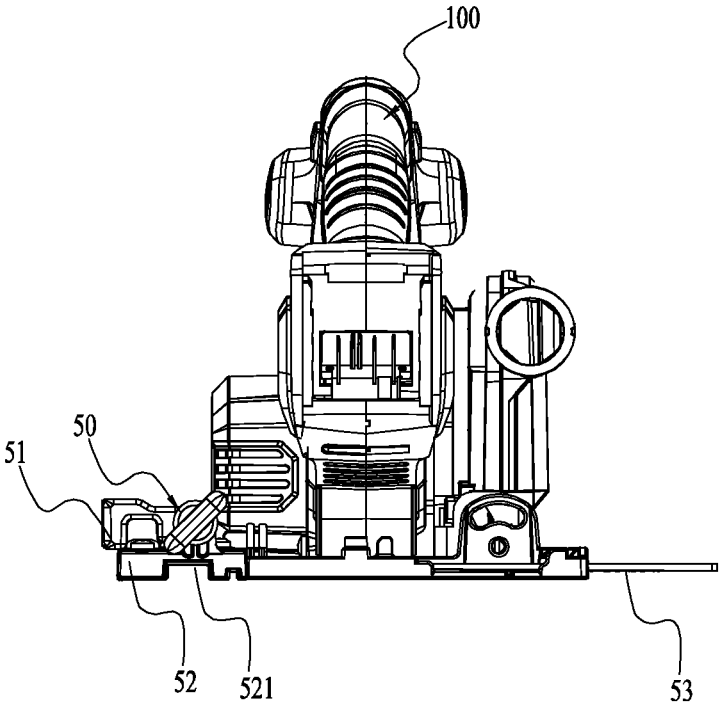

As shown in FIG. 3, FIG. 19 and FIG. 20, the bottom plate 20 is formed with a bottom plate plane 21 used for contacting with a workpiece. The bottom plate plane 21 is further parallel to the rotating axis 102 of the saw blade. The guide apparatus 50 is configured to guide the electric circular saw 100 to cut the workpiece along a straight line. The guide apparatus 50 includes a first guide piece 51, a second guide piece 52 and a combining piece 53, wherein the first guide piece 51 includes a guide plane 511 used for contacting with a side edge of the workpiece. The guide plane 511 extends along a first straight line 107. The second guide piece 52 is formed with a guide adapting portion 521 used for matching with a guide rail 201. The guide adapting portion 521 extends along a direction parallel to the first straight line 107. As shown in FIG. 19 and FIG. 25, the combining piece 53 can combine the guide apparatus 50 to a first combining position of the bottom plate 20. As shown in FIG. 21, the combining piece 53 can further combine the guide apparatus 50 to a second combining position of the bottom plate 20. The user can selectively combine the guide apparatus 50 to the first combining position or the second combining position according to actual needs. When the guide apparatus 50 is in the first combining position, the first guide piece 51 is located on an upper side of the bottom plate plane 21 and the second guide piece 52 is located on a lower side of the bottom plate plane 21 and when the guide apparatus 50 is in the second combining position, the first guide piece 51 is located on the lower side of the bottom plate plane 21 and the second guide piece 52 is located on the upper side of the bottom plate plane 21.

In this way, when the guide apparatus 50 is in the first combining position, the first guide piece 51 is located on the upper side of the bottom plate plane 21 and the second guide piece 52 is located on the lower side of the bottom plate plane 21 and the guide adapting portion 521 of the second guide piece 52 is further located on one side of a motor 12 away from the saw blade, so that the guide adapting portion 521 can be matched with the guide rail 201 and then the electric circular saw 100 can be guided through the second guide piece 52 so as to implement straight-line cutting. When the guide apparatus 50 is in the second combining position, the first guide piece 51 is located on the lower side of the bottom plate plane 21 and the second guide piece 52 is located on the upper side of the bottom plate plane 21 and the guide plane 511 of the first guide piece 51 is located on one side of the cutting piece away from the motor 12, so that the guide plane 511 can be matched with the side edge of the workpiece and then the electric circular saw 100 can be guided through the first guide piece 51 so as to implement straight-line cutting.

As shown in FIG. 3, FIG. 19 and FIG. 25, when the guide apparatus 50 is in the first combining position, the first guide piece 51 and the second guide piece 52 are located on one side of the motor 12 away from the saw blade and when the guide apparatus 50 is in the second combining position, the first guide piece 51 and the second guide piece 52 are located on one side of the saw blade away from the motor 12, wherein when the guide apparatus 50 moves from the second combining position to the first combining position, the first guide piece 51 is located at an upper side of the bottom plate plane 21. At this moment, the position of the first guide piece 51 on the upper side of the bottom plate plane 21 is easy to interfere with the motor 12. To this end, in the present disclosure, the first guide piece 51 and the second guide piece 52 further form rotatable connection by using a third axis 108 as an axis. Specifically, the third axis 108 through which the first guide piece 51 and the second guide piece 52 form rotatable connection is parallel to the direction of the first straight line 107. In this way, when the guide apparatus 50 moves from the second combining position to the first combining position, the first guide piece 51 can rotate, relative to the second guide piece 52, to one side of the motor 12 away from the saw blade, thereby avoiding generating interference between the position of the first guide piece 51 and the position of the motor 12.

In addition, in other examples, the first guide piece 51 and the second guide piece 52 may further form sliding connection, and relative sliding directions of the first guide piece 51 and the second guide piece 52 are perpendicular to the direction of the first straight line 107. In this way, when the guide apparatus 50 moves from the second combining position to the first combining position, the first guide piece 51 can slide, relative to the second guide piece 52, to one side of the motor 12 away from the saw blade, thereby avoiding generating interference between the position of the first guide piece 51 and the position of the motor 12.

As shown in FIG. 20, the combining piece 53 may be specifically a ruler which can be combined with the bottom plate 20. Scale lines 531 for indicating a size that the electric circular saw 100 cuts a workpiece can also be set on a surface of the ruler.

Figure 22:
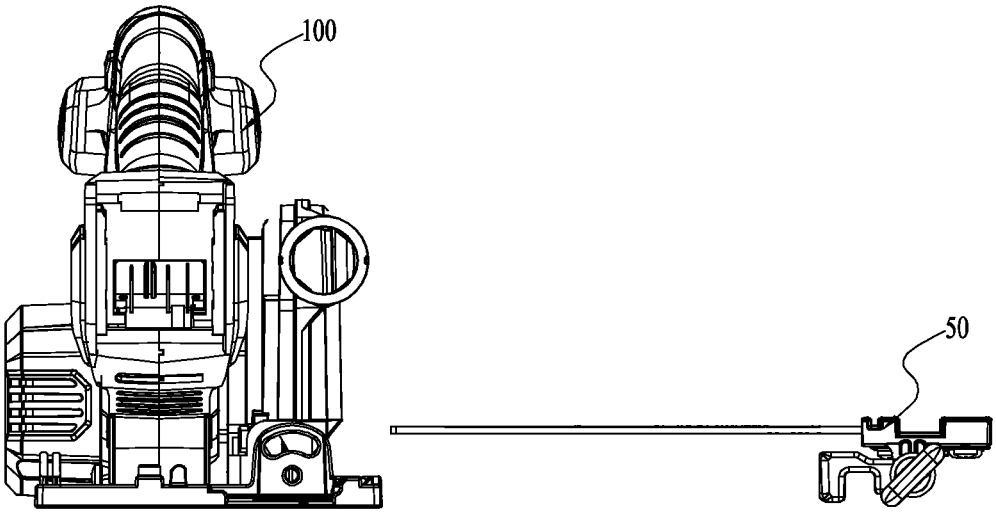
Figure 23:
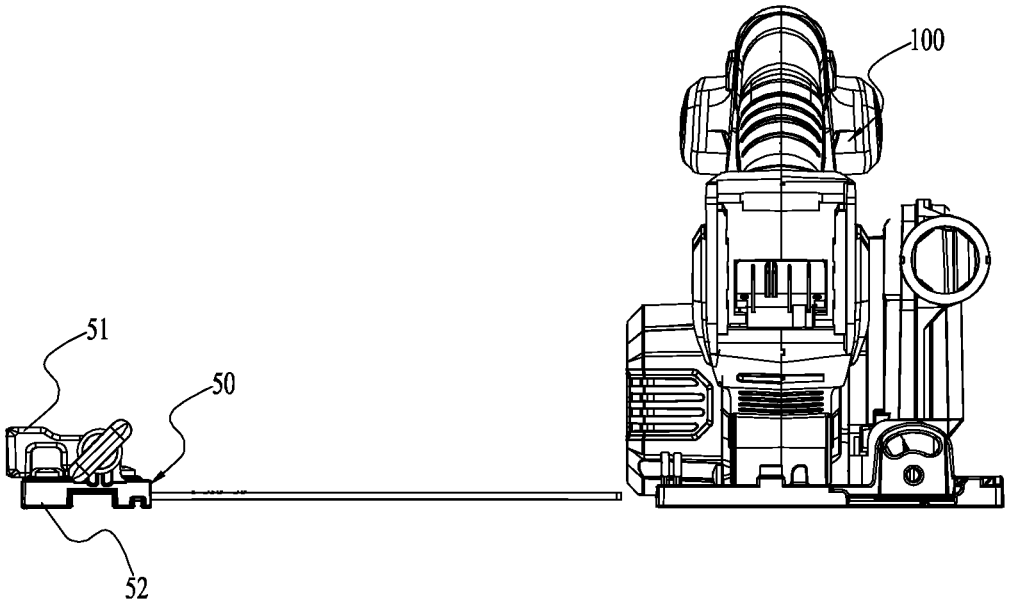
Figure 24:
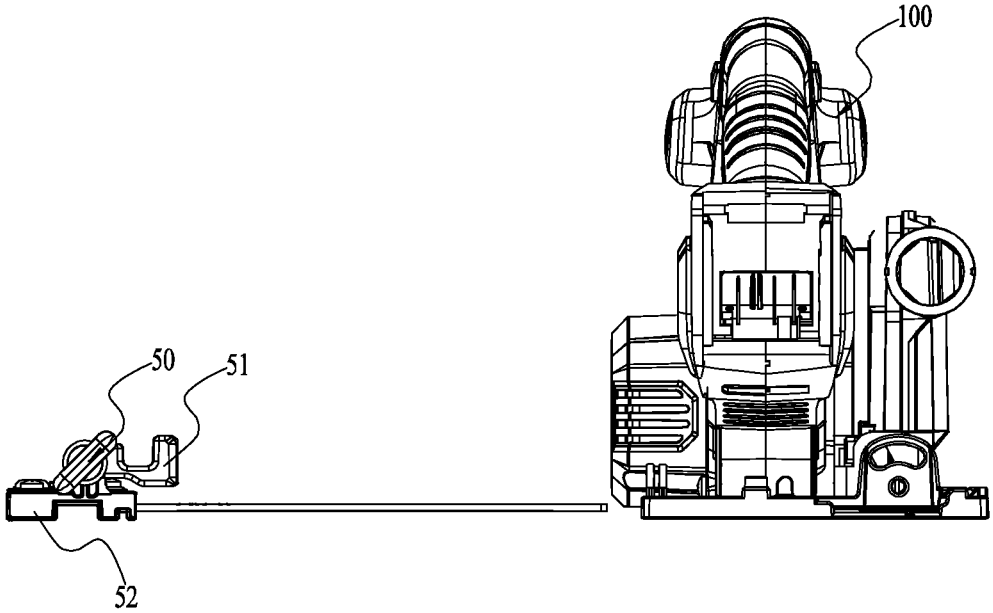

A process that the guide apparatus 50 moves from the second combining position to the first combining position is specifically disclosed below. As shown in FIG. 21, the guide apparatus 50 at this moment is in the second combining position; the guide plane 511 is then located on the lower side of the bottom plate plane 21; the guide plane 511 can come into contact with the side edge of the workpiece; then, as shown in FIG. 22 to FIG. 23, the user disassembles the guide apparatus 50 from the second combining position and turns the guide apparatus 50; then, as shown in FIG. 23 and FIG. 24, the user enables the first guide piece 51 to rotate by a certain angle relative to the second guide piece 52, and preferably 90 degrees herein; and finally, as shown in FIG. 25, the user combines the guide apparatus 50 to the first combining position.

Figure 26:
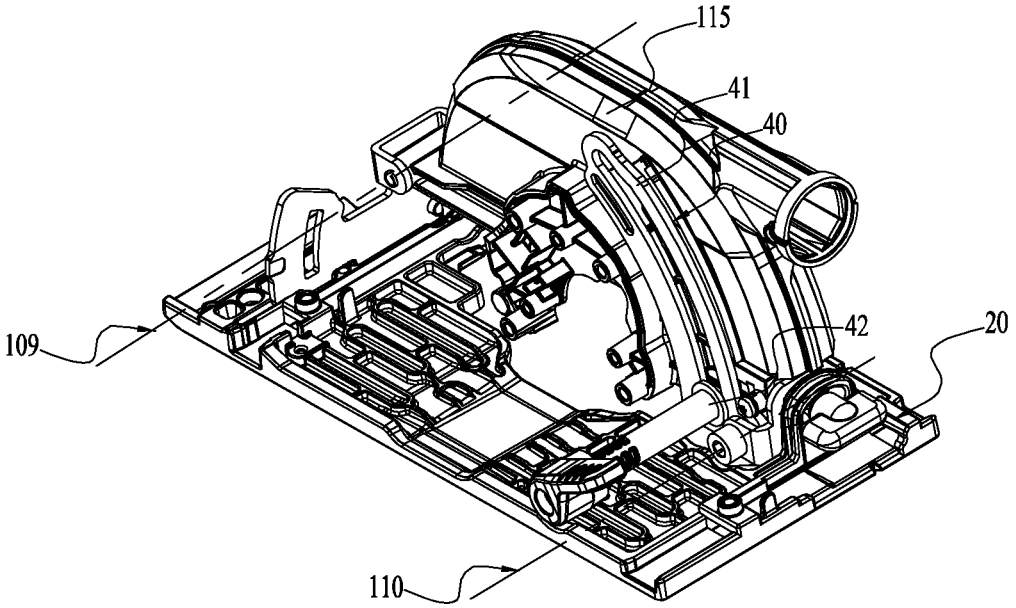
FIG. 26 is a three-dimensional diagram illustrating the bottom plate, a protective cover and a depth regulating mechanism in FIG. 1.
Figure 27:
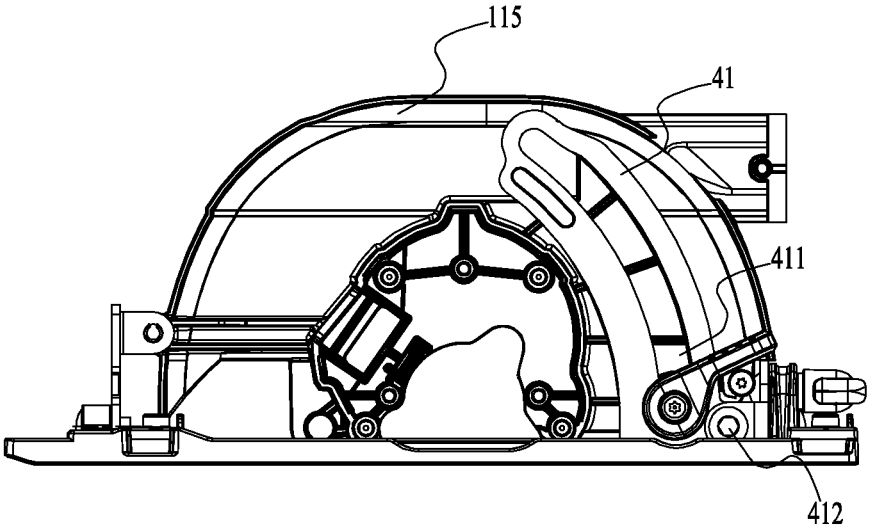
FIG. 27 is a planar diagram illustrating a structure shown in FIG. 26.
Figure 28:
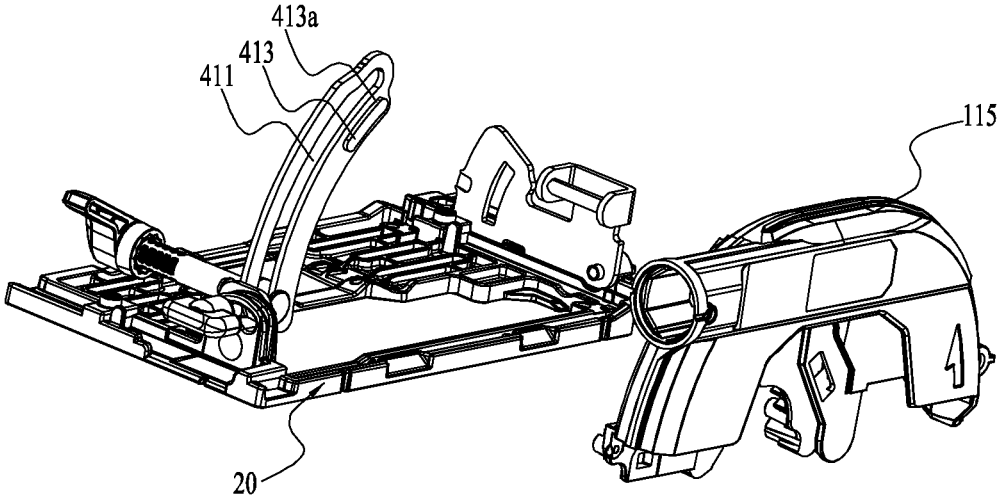
FIG. 28 is a partial exploded view illustrating the structure shown in FIG. 26.
Figure 29:
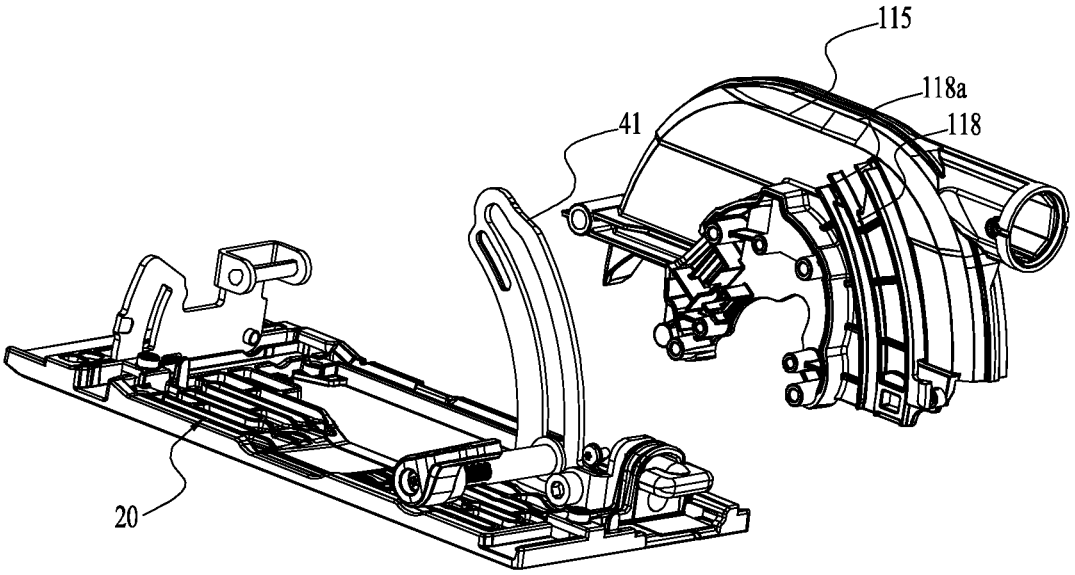
FIG. 29 is a partial exploded view illustrating another angle of the structure shown in FIG. 26.

As shown in FIG. 3 and FIG. 26, the bottom plate 20 supports the case 11 and further forms rotatable connection with the case 11 by using the first rotating axis 109 as an axis. The first rotating axis 109 is further parallel to the rotating axis 102 of the saw blade. The depth regulating mechanism 40 is configured to guide and regulate an angle of rotation of the case 11 relative to the bottom plate 20 by using the first rotating axis 109 as an axis.

As shown in FIG. 26 to FIG. 29, the depth regulating mechanism 40 includes a depth bracket 41 and a sliding rod 42. The depth bracket 41 and the bottom plate 20 form a rotatable connection by using the second rotating axis 110 as an axis. The second rotating axis 110 is parallel to the rotating axis 102 of the saw blade. The second rotating axis 110 is further parallel to, but not coincident with, the first rotating axis 109. The depth bracket 41 is formed with a circular arc hole 411. The circular arc hole 411 penetrates through the depth bracket 41 along the direction parallel to the first rotating axis 109. The sliding rod 42 forms a fixed connection with the case 11, and the sliding rod 42 further penetrates through the circular arc hole 411 and is in clearance fit with the circular arc hole 411. In this way, when the case 11 rotates relative to the bottom plate 20, the sliding rod 42 can slide in the circular arc hole 411 along the extension direction of the circular arc hole 411 and the sliding rod 42 is not always in contact with a hole wall of the circular arc hole 411. When the sliding rod 42 slides in the circular arc hole 411, although the sliding rod 42 can play a certain guide role, the swing of the depth bracket 41 is large, causing that a scale indicated by a pointer for indicating the scale on the depth bracket 41 has a deviation. In addition, it is known that when the electric circular saw 100 is made, an error may occur in a position of a rotating point 412 at which the depth bracket 41 rotates relative to the bottom plate 20. In this way, if guidance is made only through the sliding rod 42, since the sliding rod 42 moves with the case 11 and the sliding rod 42 is close to the rotating point 412 when the case 11 rotates relative to the bottom plate 20, the depth bracket 41 generates a large swing when the error occurs in the position of the rotating point 412.

However, in the present disclosure, the case 11 is further formed with a guide rail 118 for guiding relative rotation between the bottom plate 20 and the case 11 at the protective cover 115. The guide rail 118 is specifically an arc-shaped groove formed in the protective cover 115. The arc-shaped groove is formed at one side of the protective cover 115 close to the motor 12. Correspondingly, the depth bracket 41 is formed with or fixedly connected with a guide structure 413 capable of sliding along a guide track of the guide rail 118. Specifically, the guide structure 413 is a protrusion portion capable of being embedded into the groove. The protrusion portion is formed at one side of the depth bracket 41 close to the protective cover 115. A groove wall of the arc-shaped groove is a guide wall surface 118*a* extending along an arc. The protrusion portion includes a contact wall surface 413*a* capable of moving along the extension direction of the guide wall surface 118*a* when the case 11 rotates relative to the bottom plate 20 by using the first rotating axis 109 as an axis. The contact wall surface 413*a* has a contact point which is always in contact with the guide wall surface 118*a*. More specifically, the protrusion portion has an approximate waist shape. One of two opposite waists of the protrusion portion is always in contact with one groove wall of the groove and thus can be regarded as the contact wall surface 413*a* and the other waist can form a spacing of 0.5 mm with the other groove wall of the groove. At this moment, each point on the waist of the protrusion portion in constant contact with the groove can be regarded as the above contact point, wherein the protrusion portion and the depth bracket 41 are integrally formed. Therefore, a distance between the contact point of the protrusion portion and the rotating point 412 at which the depth bracket 41 rotates relative to the bottom plate 20 is fixed. In this way, the rotation of the case 11 relative to the bottom plate 20 is guided through the slide of the protrusion portion in the groove so that the swing of the depth bracket 41 is reduced and the error of the rotating point 412 in manufacture has a relatively small effect on the amplitude of the swing generated by the depth bracket 41.

Further, the protrusion portion is arranged on one end of the depth bracket 41 away from the rotating point 412, and the distance between the contact point and the rotating point 412 at which the depth bracket 41 rotates relative to the bottom plate 20 is greater than or equal to 50 mm and less than or equal to 150 mm. In this way, the effect of the error of the rotating point 412 in manufacture on the swing generated by the depth bracket 41 can be further reduced. In addition, the guide track of the guide rail 118 is a section of arc with changing curvature.

Figure 30:
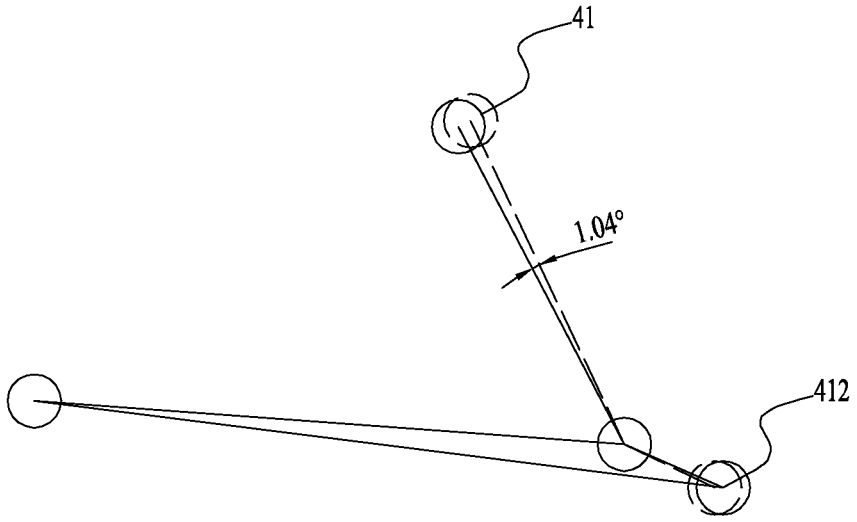
FIG. 30 is a diagram illustrating swing generated by a depth bracket when the depth bracket only performs guidance through a sliding rod.
Figure 31:
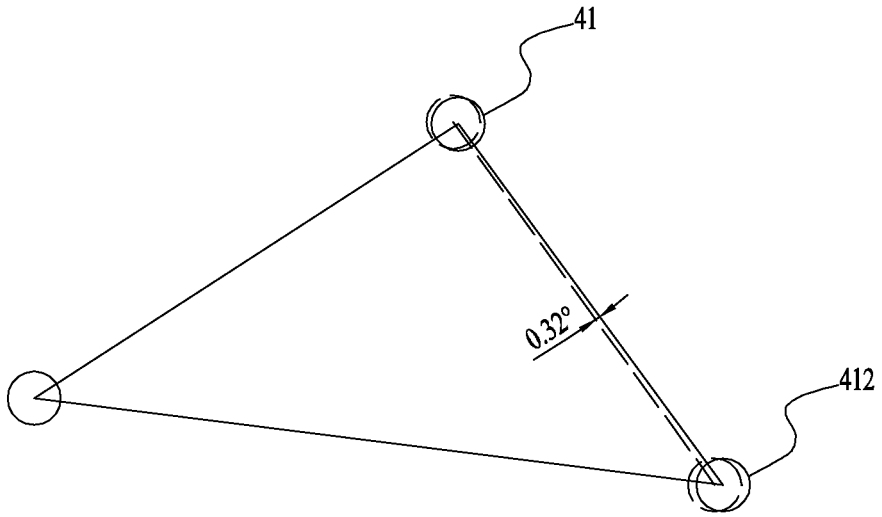
FIG. 31 is a diagram illustrating swing generated by a depth bracket when the depth bracket performs guidance through a protrusion portion.

When the depth bracket 41 guides only through the sliding rod 42 arranged in the circular arc hole 411, as shown in FIG. 30, if the rotating point 412 generates a manufacturing error of 0.5 mm, then the depth bracket 41 generates a large amplitude of swing. It can be seen from FIG. 30 that a swing angle generated by the depth bracket 41 is 1.04 degrees. However, when the depth bracket 41 guides through the protrusion portion arranged on the depth bracket 41, as shown in FIG. 31, if the rotating point 412 generates a manufacturing error of 0.5 mm, then the depth bracket 41 generates a small amplitude of swing. It can be seen from FIG. 31 that a swing angle generated by the depth bracket 41 is 0.32 degree. It can be known from this that the arrangement of the protrusion portion can eliminate the swing generated by the depth bracket 41 and caused by the manufacturing error, thereby improving precision of depth indication without adding cost or adding structural complexity.

Figure 32:
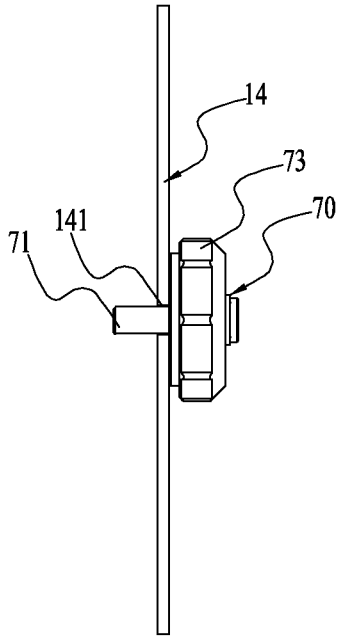
FIG. 32 is a planar diagram illustrating a working accessory and a fastening apparatus in FIG. 1.
Figure 33:
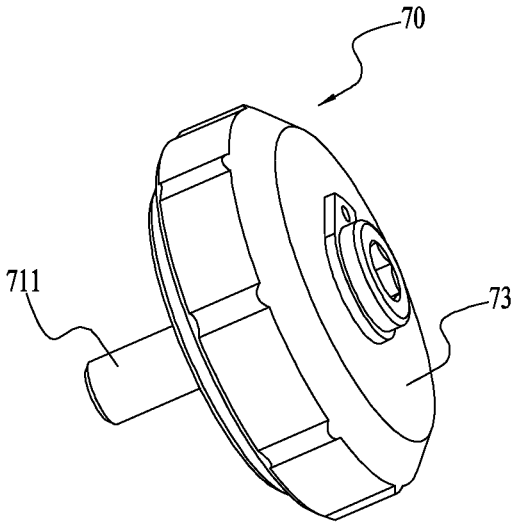
FIG. 33 is a three-dimensional diagram illustrating the fastening apparatus in FIG. 32.
Figure 34:
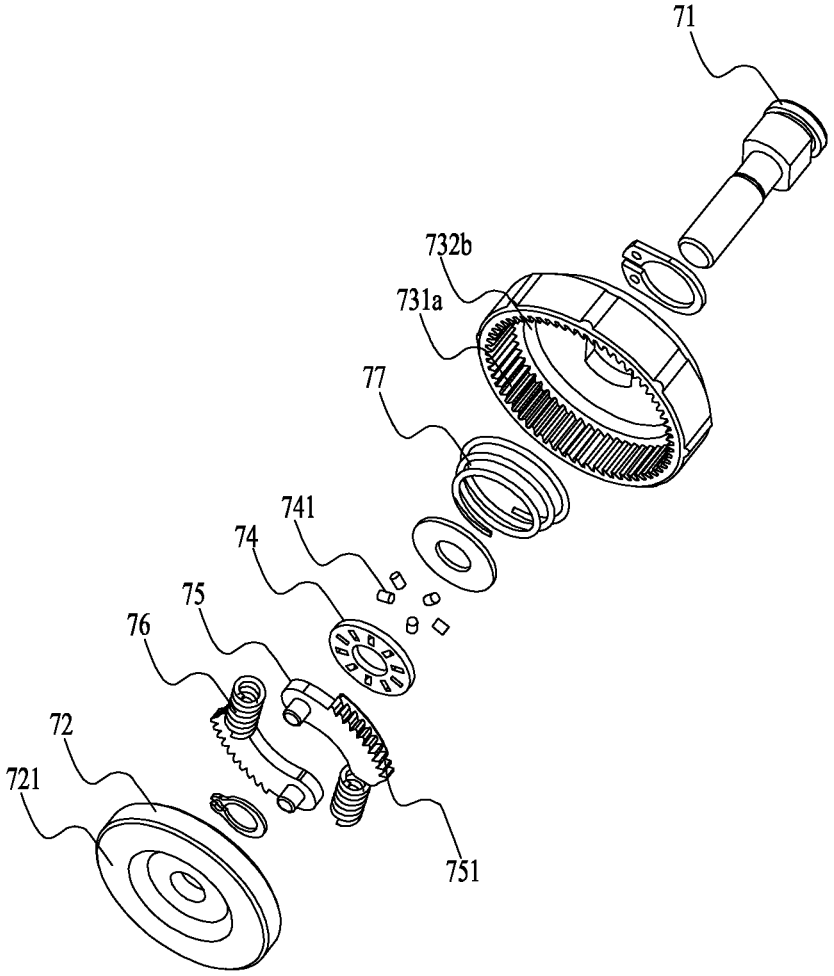
FIG. 34 is an exploded view illustrating the fastening apparatus in FIG. 33.
Figure 35:
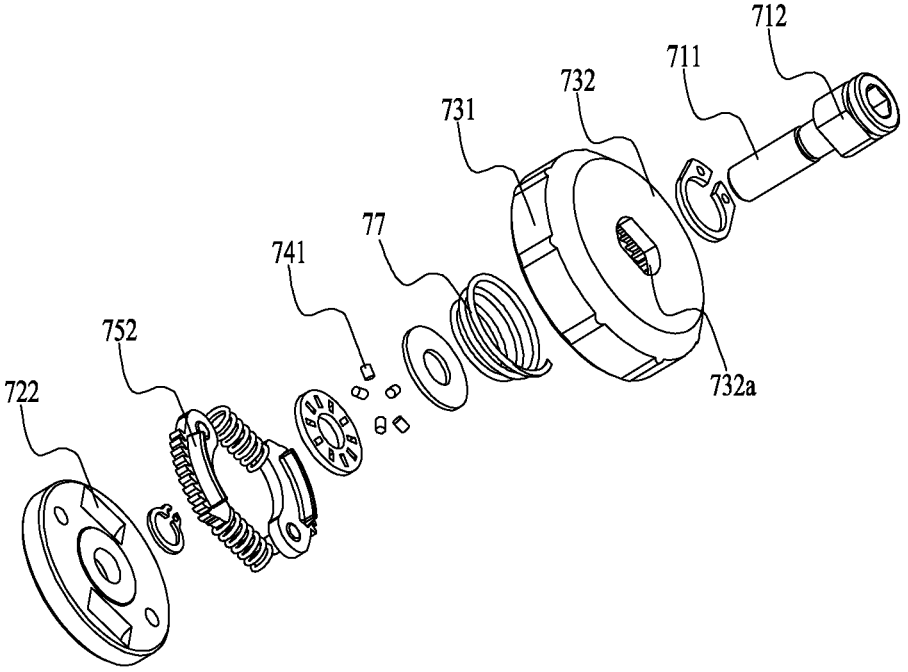
FIG. 35 is an exploded view illustrating another angle of the fastening apparatus in FIG. 33.

As shown in FIG. 2 and FIG. 32, the electric circular saw 100 further includes a fastening apparatus 70 used for installing the working accessory 14 to the tool main engine 10, wherein an installing hole 141 is formed in the working accessory 14. Specifically, the working accessory 14 is the above mentioned saw blade applied to the electric circular saw 100. The installing hole 141 penetrates through the saw blade along the direction of the rotating axis 102 of the saw blade.

As shown in FIG. 32 to FIG. 35, the fastening apparatus 70 includes a fastening piece 71, a clamping piece 72, an operating piece 73, a rolling piece 741, a converting piece 75 and a first biasing element 76.

The fastening piece 71 includes a fastening portion 711. The fastening portion 711 penetrates through the installing hole 141. The fastening portion 711 further extends into the driving shaft 15 and forms a rotatable connection with the driving shaft 15. The fastening portion 711 can further drive the entire fastening apparatus 70 to keep close to or away from the tool main engine 10 when rotating relative to the driving shaft 15. The clamping piece 72 is rotatably installed to the fastening piece 71. The clamping piece 72 is further formed with a clamping surface 721 for contact with the working accessory 14. The operating piece 73 is used by the user to operate. The operating piece 73 and the fastening piece 71 form synchronous rotation. The rolling piece 741 is arranged between the clamping piece 72 and the operating piece 73. The rolling piece 741 can roll relative to the clamping piece 72 and the operating piece 73. The converting piece 75 is also arranged between the clamping piece 72 and the operating piece 73. The converting piece 75 further has a first position state that enables the clamping piece 72 and the operating piece 73 to form synchronous rotation and a second position state that enables the clamping piece 72 and the operating piece 73 to form relative rotation. The first biasing element 76 applies, to the converting piece 75, a biasing force that enables the converting piece 75 to move towards the first position state.

In this way, when the user needs to install or disassemble the working accessory 14, the converting piece 75 can overcome the bias pressure of the first biasing element 76 and can be in the second position state that enables the clamping piece 72 and the operating piece 73 to form relative rotation; and then, the user operates the operating piece 73, thereby driving the fastening piece 71 to move towards the position that enables the clamping surface 721 to keep close to or away from the working accessory 14. At this moment, since the clamping piece 72 and the operating piece 73 form relative rotation, the force applied to the operating piece 73 by the user only needs to overcome friction force between the fastening piece 71 and the driving shaft 15 and rolling friction force between the rolling piece 741 and the clamping piece 72 or the operating piece 73. Since the rolling friction force is small, the force applied to the operating piece 73 by the user is mainly used for overcoming the friction force between the fastening piece 71 and the driving shaft 15 so that the user can install or disassemble the working accessory 14 more effortlessly.

Specifically, an external thread is arranged on a surface of the fastening portion 711. In this way, when the fastening portion 711 rotates, the fastening portion 711 can move in the direction of the rotating axis relative to the driving shaft 15. The fastening piece 71 further penetrates through a flat hole 732*a* arranged in the operating piece 73. The fastening piece 71 is provided with a flat portion 712 used for matching with the flat hole 732*a*. The operating piece 73 and the fastening piece 71 form synchronous rotation through matching of the flat portion 712 and the flat hole 732*a*.

The number of the converting pieces 75 is two. Two converting pieces 75 are symmetrically arranged on one side of the clamping piece 72 away from the clamping surface 721. Specifically, one end of the converting pieces 75 is rotatably connected to one side of the clamping piece 72 away from the clamping surface 721, and the other end is connected with the first biasing element 76. An axis around which the converting pieces 75 rotate relative to the clamping piece 72 is further parallel to the axis around which the clamping piece 72 rotates relative to the fastening piece 71; and when the converting pieces 75 rotate relative to the clamping piece 72, the converting pieces 75 can rotate to the first position state and the second position state. An accommodating groove 722 is formed at one side of the clamping piece 72 away from the clamping surface 721. The first biasing element 76 is specifically a helical spring arranged in the accommodating groove 722. One end of the helical spring is abutted against a groove bottom of the accommodating groove 722, and the other end is abutted against the converting pieces 75. The operating piece 73 and the converting pieces 75 are respectively formed with a first transmission portion 731*a* and a second transmission portion 751 which enable the clamping piece 72 and the operating piece 73 to form synchronous rotation when the operating piece 73 and the converting pieces 75 are mutually matched. Specifically, the operating piece 73 includes a tooth ring portion 731 and an end cover portion 732. Inner teeth are arranged on an inner circumference of the tooth ring portion 731. The inner teeth are the first transmission portion 731*a*. Correspondingly, the converting pieces 75 are further formed with outer teeth which can be engaged with the inner teeth of the tooth ring portion 731 of the inner teeth. The outer teeth are the second transmission portion 751.

The operating piece 73 is further formed with a driving portion for driving the converting pieces 75 to prevent the bias of the first biasing element 76 from moving towards the second position state. Specifically, the operating piece 73 and the fastening piece 71 further form sliding connection along the direction of the rotating axis of the fastening piece 71. The driving portion is a first bevel 732*b* formed on one side of the end cover portion 732 close to the clamping piece 72. Correspondingly, the converting pieces 75 are formed with a second bevel 752 which can be matched with the first bevel 732*b*. In this way, when the operating piece 73 slides towards the direction close to the clamping piece 72, the first bevel 732*b* drives the second bevel 752 so that the converting pieces 75 move towards the second position state.

In addition, the rolling piece 741 may be specifically a rolling pin in a rolling bearing 74, and the rolling bearing 74 is arranged between the clamping piece 72 and the operating piece 73. A second biasing element 77 is further arranged between the operating piece 73 and the rolling bearing 74, and the second biasing element 77 applies, to the operating piece 73, a biasing force that enables the operating piece 73 to slide towards the direction away from the clamping piece 72.

When the working accessory 14 is locked by the fastening apparatus 70 to the driving shaft 15, the second biasing element 77 biases the operating piece 73 and enables the operating piece 73 to be in a position away from the clamping piece 72, and the first biasing element 76 biases the converting pieces 75 and enables the converting pieces 75 to be in the first position state. At this moment, the first transmission portions 731*a* and the second transmission portions 751 are mutually matched so that the clamping piece 72 and the operating piece 73 form synchronous rotation. If the user directly rotates the operating piece 73 to disassemble the working accessory 14 at this moment, then the rotating force applied to the operating piece 73 by the user not only needs to overcome the friction force between the fastening piece 71 and the driving shaft 15, but also needs to overcome static friction force between the clamping piece 72 and the working accessory 14, and the static friction force is large. Therefore, the user takes too much effort to rotate the operating piece 73. However, in the present disclosure, when the user needs to disassemble the working accessory 14, in fact, the user can firstly press the operating piece 73. At this moment, the converting piece 75 can be driven to rotate to the second position state through the cooperation of the first bevel 732*b* and the second bevel 752, thereby separating the first transmission portions 731*a* from the second transmission portions 751, so that the operating piece 73 can rotate relative to the clamping piece 72. Then, the user rotates the operating piece 73. At this moment, the rotating force applied to the operating piece 73 by the user only needs to overcome the friction force between the fastening piece 71 and the driving shaft 15 and the rolling friction force between the rolling piece 741 and the clamping piece 72 or the operating piece 73. Since the rolling friction force is small, the force applied to the operating piece 73 by the user is mainly used for overcoming the friction force between the fastening piece 71 and the driving shaft 15 so that the user can install or disassemble the working accessory 14 more effortlessly.

In fact, the fastening apparatus 70 not only can be used for installing the saw blade to a saw tool, but also can be used for installing a grinding sheet to an angle grinder, and certainly is not limited to this It should be noted that, if it is not strictly described that some holes in the present disclosure penetrate through a certain part in a certain direction, then the holes can be replaced by grooves. Namely, some grooves in the present disclosure can also be replaced by holes, and some holes can also be replaced by grooves.

The above shows and describes a basic principle, main features and advantages of the present disclosure. Those skilled in the art should understand that above examples do not limit the present disclosure in any form. Technical solutions obtained by adopting equivalent replacements or equivalent transformations fall within a protection scope of the present disclosure.

We claim:

1. A circular saw, comprising:

a circular saw blade;

a motor configured to drive the circular saw blade to rotate around a first axis;

a case comprising a motor case portion for accommodating at least a portion of the motor and a protective cover covering at least a portion of the circular saw blade;

a bottom plate supporting the case and forming a rotatable connection with the case around a first rotating axis parallel to the first axis; and a depth bracket forming a rotatable connection with the bottom plate around a second rotating axis parallel to the first axis, wherein the protective cover is formed with a guide wall surface extending along an arc, the depth bracket comprises a contact wall moving along an extension direction of the guide wall surface when the case rotates relative to the bottom plate around the first rotating axis, and the contact wall surface is in contact with the guide wall surface when the case rotates relative to the bottom plate around the first rotating axis, and wherein the guide wall surface is an arc-shaped groove formed on the protective cover for guiding the relative rotation between the bottom plate and the case, and the depth bracket is formed with a guide structure capable of sliding along a guide track of the guide wall surface and the guide structure is a protrusion portion formed on the depth bracket and capable of being embedded into the arc-shaped groove.

2. The circular saw according to claim 1, wherein the contact wall surface comprises a contact point always contacting the guide wall surface when the case rotates relative to the bottom plate around the first rotating axis, and a distance between the contact point and a rotating point at which the depth bracket rotates relative to the bottom plate is fixed.

3. The circular saw according to claim 2, wherein the distance between the contact point and the rotating point at which the depth bracket rotates relative to the bottom plate is greater than or equal to 50 mm and less than or equal to 150 mm.

4. The circular saw according to claim 1, wherein the depth bracket is further formed with an arc hole penetrating through the depth bracket along a direction parallel to the first rotating axis, the circular saw further comprises a sliding rod connected with the case, and the sliding rod passes through the arc hole.

5. The circular saw according to claim 4, wherein the sliding rod is in clearance fit with the arc hole.

6. The circular saw according to claim 1, wherein the guide wall surface is arranged at a side of the protective cover close to the motor.

7. The circular saw according to claim 1, wherein the depth bracket is arranged behind the protective cover and the guide wall surface is provided on a rear surface of the protective cover.

8. A circular saw, comprising:

a motor configured to drive a circular saw blade to rotate around a first axis;

a case comprising a motor case portion for accommodating at least a portion of the motor and a protective cover covering at least a portion of the circular saw blade;

a bottom plate supporting the case and forming a rotatable connection with the case around a first rotating axis parallel to the first axis; and a depth bracket forming a rotatable connection with the bottom plate around a second rotating axis parallel to the first axis, wherein the case is formed with a first guide structure for guiding a relative rotation between the bottom plate and the case, the depth bracket is formed with a matching structure for matching with the first guide structure, and the matching structure is capable of sliding along a guide track of the guide structure when the case rotates relative to the bottom plate around the first rotating axis, and wherein the first guide structure is an arc-shaped groove formed on the protective cover, and the matching structure is formed with a guide structure being a protrusion portion formed on the depth bracket and capable of being embedded into the arc-shaped groove.

9. The circular saw according to claim 8, wherein the matching structure is formed on one end of the depth bracket away from a rotating point at which the depth bracket rotates relative to the bottom plate.

10. The circular saw according to claim 8, wherein the matching structure comprises a contact point which always contact the first guide structure when the case rotates relative to the bottom plate around the first rotating axis.

11. A circular saw, comprising:

a circular saw blade;

a motor configured to drive the circular saw blade to rotate around a first axis;

a case comprising a motor case portion for accommodating at least a portion of the motor and a protective cover covering at least a portion of the circular saw blade;

a bottom plate supporting the case and forming a rotatable connection with the case around a first rotating axis parallel to the first axis; and a depth bracket forming a rotatable connection with the bottom plate around a second rotating axis parallel to the first axis, wherein the protective cover is formed with a guide rail for guiding a relative rotation between the bottom plate and the case, and the depth bracket is formed with a guide structure capable of sliding along a guide track of the guide rail, and wherein the guide rail is an arc-shaped groove formed on the protective cover and the guide structure is a protrusion portion formed on the depth bracket and capable of being embedded into the arc-shaped groove.

12. The circular saw according to claim 11, wherein the guide track of the guide rail is an arc with changing curvature.

13. The circular saw according to claim 11, wherein the protrusion portion is formed on one end of the depth bracket away from a rotating point at which the depth bracket rotates relative to the bottom plate.

14. The circular saw according to claim 11, the arc-shaped groove comprises a guide wall surface for guiding the protrusion portion to slide, and the protrusion portion comprises a contact point which always contacts the guide wall surface when the case rotates relative to the bottom plate around the first rotating axis.

15. The circular saw according to claim 14, wherein a distance between the contact point and the rotating point at which the depth bracket rotates relative to the bottom plate is greater than or equal to 50 mm and less than or equal to 150 mm.

16. The circular saw according to claim 11, wherein the guide rail is arranged at a side of the protective cover close to the motor.

17. The circular saw according to claim 11, wherein the depth bracket is arranged behind the protective cover and the guide rail is provided on a rear surface of the protective cover.

18. The circular saw according to claim 11, wherein the depth bracket is further formed with an arc hole penetrating through the depth bracket along a direction parallel to the first rotating axis, the circular saw further comprises a sliding rod connected with the case, and the sliding rod passes through the arc hole.

19. The circular saw according to claim 18, wherein the sliding rod is in clearance fit with the arc hole.

* * * * *